United States Patent [19]

Stephens et al.

[11] Patent Number: 5,051,010

[45] Date of Patent: Sep. 24, 1991

[54] PRINTER AND CARTRIDGE ASSEMBLY THEREFOR

[75] Inventors: Fred O. Stephens; Frank A. Ellis, both of Waynesboro, Va.

[73] Assignee: Genicom Corporation, Waynesboro, Va.

[21] Appl. No.: 553,731

[22] Filed: Jul. 17, 1990

Related U.S. Application Data

[62] Division of Ser. No. 400,001, Aug. 29, 1989.

[51] Int. Cl.[5] ..... B41J 32/00

[52] U.S. Cl. ..... 400/194; 400/195; 400/196.1; 400/208; 400/247

[58] Field of Search ..... 400/609, 194, 195, 196, 400/196.1, 207, 208, 208.1, 247

[56] References Cited

U.S. PATENT DOCUMENTS

| | | | |
|---|---|---|---|
| 3,977,512 | 8/1976 | Teagarden et al. | 400/195 |
| 4,074,800 | 2/1978 | Steinke | 400/196 |
| 4,130,367 | 12/1978 | Guerrini et al. | 400/195 |
| 4,131,372 | 12/1978 | Hengelhaupt | 400/196.1 |
| 4,157,224 | 6/1979 | Purzycki et al. | 400/196 |
| 4,213,715 | 7/1980 | Haftmann et al. | 400/196.1 |
| 4,279,522 | 7/1981 | Yonkers | 400/195 |
| 4,317,636 | 3/1982 | Hume | 400/196 |
| 4,325,646 | 4/1982 | Sasaki | 400/196.1 |
| 4,388,006 | 6/1983 | Waibel | 400/196 |
| 4,630,948 | 12/1986 | Karns | 400/196.1 |
| 4,650,355 | 3/1987 | Cassiano et al. | 400/196.1 |
| 4,880,323 | 11/1989 | Milliser et al. | 400/196 |
| 4,940,345 | 7/1990 | Raar | 400/195 |
| 4,968,161 | 11/1990 | Kunitomi et al. | 400/196.1 |

FOREIGN PATENT DOCUMENTS

| | | | |
|---|---|---|---|
| 0019649 | 12/1980 | European Pat. Off. | 400/196.1 |
| 2853329 | 6/1979 | Fed. Rep. of Germany | 400/196.1 |
| 3446057 | 6/1986 | Fed. Rep. of Germany | 400/195 |
| 3513766 | 10/1986 | Fed. Rep. of Germany | 400/196.1 |
| 0055888 | 4/1980 | Japan | 400/196.1 |
| 0173689 | 10/1983 | Japan | 400/196 |
| 59-95181 | 6/1984 | Japan | 400/196.1 |
| 1525203 | 9/1978 | United Kingdom | 400/196.1 |
| 2184998 | 7/1987 | United Kingdom | 400/196.1 |

*Primary Examiner*—Eugene H. Eickholt
*Attorney, Agent, or Firm*—Nixon & Vanderhye

[57] ABSTRACT

A printer has one or more tractor sets for continuously feeding paper along first and second paper paths. One tractor set may be pivoted between positions for feeding paper from the front or bottom of the printer along the first paper path. Where one tractor set is used, it may be removed from the first feed path and disposed along the second paper path to feed paper along the second paper path for printing. Where two tractor sets are provided, the second set is disposed along the second paper path to feed the paper along the second path for printing. The tractor sets are detachable and usable in each of the three tractor set feed positions. Other features include eccentric bearings, resilient roller assemblies, an integrally molded mainframe and a cartridge assembly having a one-way ribbon advance clutch and a tensioning device before the mobius loop.

11 Claims, 13 Drawing Sheets

FIG. 11
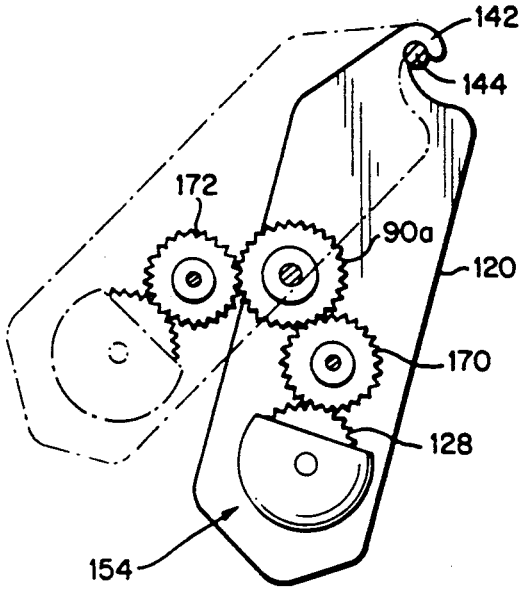
FIG. 12
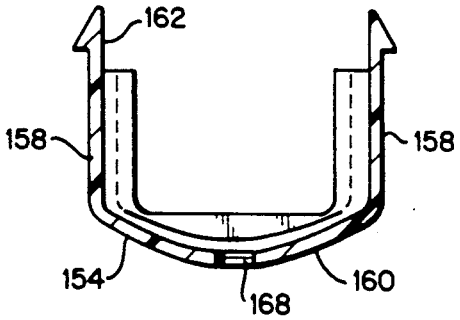
FIG. 13
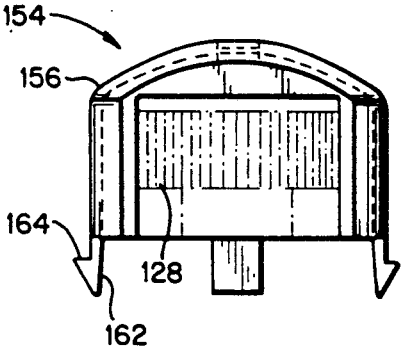
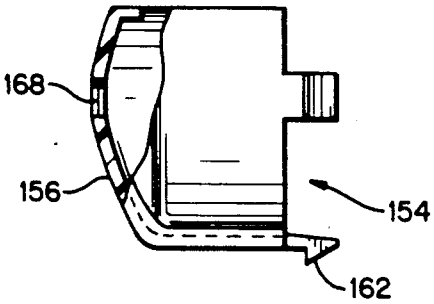
FIG. 14
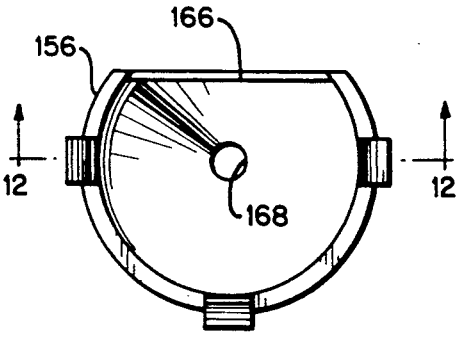
FIG. 15

FIG. 16
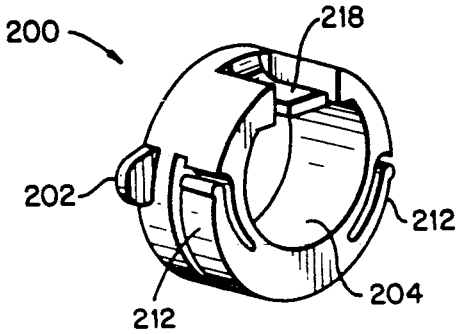
FIG. 17
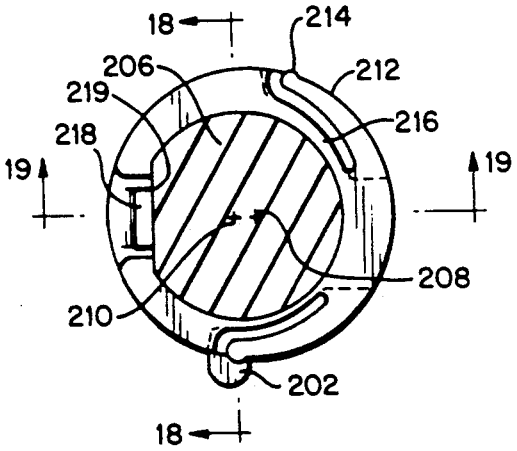
FIG. 18
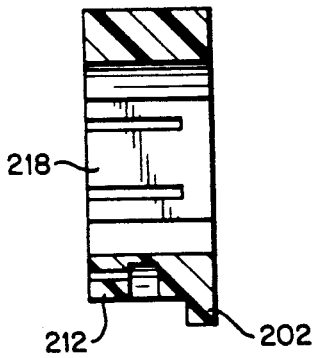
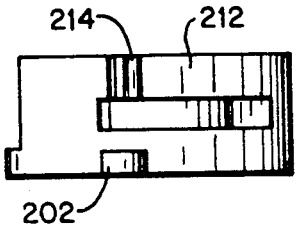
FIG. 20
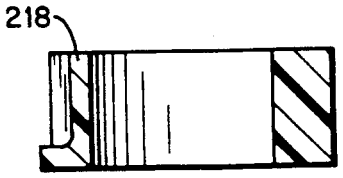
FIG. 19

FIG. 26
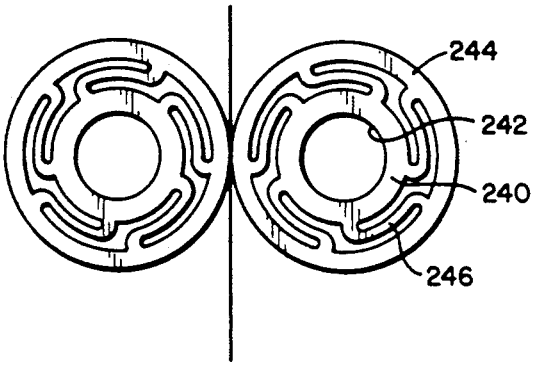
FIG. 27
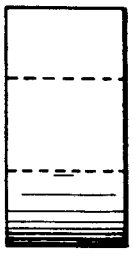
FIG. 21
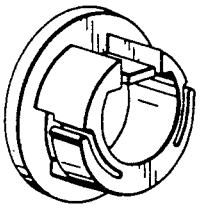
FIG. 22
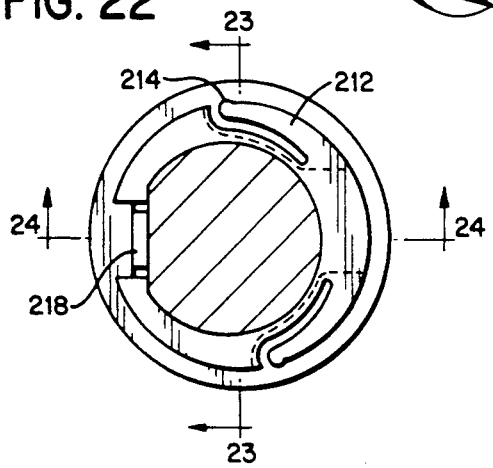
FIG. 23
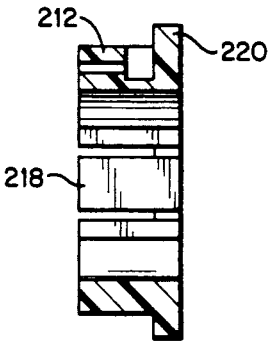
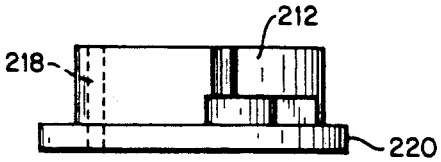
FIG. 25
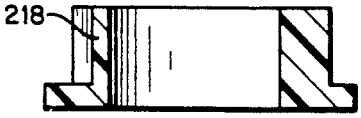
FIG. 24

302
304
306
308
312
314
320
322
324
326
327
330
331
332
33
344a
R
30
31
32
344
346

PRINTER AND CARTRIDGE ASSEMBLY THEREFOR

This is a division of application Ser. No. 400,001 filed Aug. 29, 1989.

BACKGROUND AND SUMMARY OF THE INVENTION

The present invention relates to a printer and cartridge assembly and particularly relates to improved apparatus and methods for constructing and operating a high-speed printer and an improved printer ribbon cartridge.

High-speed printers are, of course, well known. Due to evolving customer needs, it has become desirable in many instances to increase the paper handling capability of printers, while simultaneously affording flexibility in handling the paper. For example, it has become desirable to provide multiple paper paths for feeding different types of paper into the printer for different purposes, without the necessity of manually removing one type of paper from the printer in order to feed a different type of paper. More particularly, in a prior printer sold by assignee of the present application, there was provided a single rear paper path including a tractor assembly for the paper, together with an option for a bottom paper feed path. However, the bottom feed path constituted only a roller path and not a tractor-driven paper path. In many situations, tractor feed is more desirable than a friction-driven roller feed because of the precise nature of the feed and the current increasing use of continuous form computer paper. Consequently, it has been found desirable to provide at least two tractor feed paper paths for a printer for feeding paper to the printhead along different paths, i.e., from the front or bottom of the printer along a first path or from the rear of the printer along a second path. It is also desirable to use the same tractor set along each of the two paths or provide two tractor sets for use in the respective paper paths depending on customer needs. Where two tractor sets are employed, the capability of parking the paper in each feed path while feeding paper along the other feed path has also been found desirable. Additionally, and for added flexibility, the printer should have the capability of handling cut-sheet paper manually fed to the printer as well as cut-sheet paper automatically fed to the printer.

Further, many prior printers have various constructional features which substantially increase the cost of manufacture, not only in terms of the cost of the parts necessary to fabricate the printer, but also in terms of the labor necessary to adjust the printer for its designed operations, once assembled. For example, the roller drives on the printer shafts are conventionally formed of a rather expensive material and there has been a need to reduce the expense of those rollers without sacrificing performance. Additionally, printer mainframes have previously been built up from a substantial number of parts, certain of which require adjustment if the printer head in association with the striker bar is to print correctly. Lack of proper initial adjustment, and parts coming out of adjustment with use, have been continuing problems.

Various improvements in the design of the ribbon cartridge itself are possible to reduce the costs of the manufacture of the cartridge, as well as to enhance the performance of the printer. For example, not infrequently the mobius loop of the printer cartridge is ineffective to invert the printer ribbon. The ribbon then extends between the exit and entrance arms of the cartridge in a twisted state, resulting in defective printing. Additionally, mishandling of the cartridge prior to installation in the printer has been a problem. This sometimes results in the printer ribbon being jammed and prevented from being advanced.

The present invention therefore provides novel and improved apparatus and methods for enhancing the performance and capability of a high-speed printer in terms of both the apparatus and methods for printing, as well as effectively reducing the cost of manufacturing the printer. In this connection, it will be appreciated that there are a host of individually improved features in the printer and cartridge hereof which collectively give rise to substantial overall improvements in printer operation and that of its cartridge and that, additionally, there are many novel features which are each notable in their own right as well as when taken in various combinations and permutations.

Therefore, in one aspect of the present invention, there is provided a printer having a printer paper feed path system which enables continuous feed of paper along two paper paths. The paper in each path can be parked so that the paper in the other path can be fed to the printhead for printing. Each paper path may be provided with a tractor set so that continuous forms may be advanced along the selected paper path for printing. Through a novel mounting of the tractor set associated therewith, continuous feed of paper into the print position from either one side, preferably the front, or from the bottom of the printer, is provided along a first paper path. The other, or second, paper path may be located to receive paper through an opening in another side, preferably the rear of the printer, for feeding paper continuously to the print position. Additionally, a third paper path is provided for either manually or automatically feeding cut-sheet paper to the print position. For manual feed, the paper in the first and second paper feed paths is parked in the associated tractor set. For automatic feed of cut-sheet paper, the paper in the second path must be removed, although the paper in the first path must be parked if installed in its associated tractor set.

For certain customer uses, only one tractor set for the continuous feed of paper is employed. Such tractor set is interchangeable between positions for feeding paper continuously along the first and second respective paper paths. For example, when the tractor set is employed for feeding paper along the first paper path, the tractor set may be disposed in alternate positions to feed paper continuously from paper inlet openings disposed in the front or bottom of the printer. Should it be desirable to continuously feed paper from the rear of the printer, the one tractor set may be removed from the first paper path and disposed in the second paper path, whereby paper may be continuously fed from the rear paper inlet opening to the printhead.

There is also provided in accordance with the present invention a novel arrangement of a drive mechanism for purposes of driving the tractor set in any one of its three positions described previously. For example, a drive motor mounted to one side of the printer housing and through a continuously driven belt provides power to a pair of clutch assemblies. When the tractor set is disposed to supply paper along the first path, the clutch assembly associated therewith is actuated such that the belt drive assembly is connected to a drive gear, in turn connected to a tractor set drive gear for advancing the paper. As detailed hereinafter, that tractor drive gear is operable to advance the paper in the tractor set in both of its feed positions for feeding paper through the front or bottom paper inlet openings along the first paper path. When the tractor set is removed from the first paper path and disposed in the second paper path, selection of the second or rear paper feed path from the control panel actuates the second clutch assembly to enable the belt drive to couple another set of drive gears to the printer motor, whereby the tractor set, in the second path, may be continuously driven.

Where two tractor sets are used, a continuous form may be installed in the first tractor set disposed in the bottom or front position to feed paper along the first paper path and an additional continuous form may be installed in the second tractor set disposed in the rear position to feed paper along the second paper path. These forms need not be the same width, length, thickness, weight, etc. When one paper path is selected from the control panel, the other path remains in a paper parked position. That is, the continuous form in the tractor set disposed in the non-selected paper path remains in that tractor set, with its leading edge spaced from the printer drive roller and printhead. This enables the paper in the other tractor set to be fed to the printhead.

More particularly, a load switch on the control panel is pushed to move the paper along the selected paper path to the print position. Other normal print commands follow. When the operator wishes to park this form and use the form parked in the other paper path, the paper may be cut using a method such as a form feed function followed by a tear-off function selected at the control panel. In that method, the paper in the currently selected paper path is then moved to a convenient position to tear the paper off against a tear surface, at which time the paper may be returned by the operator or timed to move back into its normal printing position. The park/path command is then selected and this retracts the paper in the currently selected paper path such that its leading edge is disposed in its tractor set. The park/path control switch is then actuated until the other newly selected paper path is identified on the control panel. Upon the next paper movement command, the clutch solenoid for the previously selected path is deactivated and the solenoid for the clutch assembly of the newly selected path is actuated. This enables the tractor set in the selected paper path to advance the paper therein to the print position where normal print commands may follow for printing on the selected paper. All of the above control panel commands can also be obtained remotely from a data source using escape codes.

It will be appreciated that, with one tractor set disposed along either of the first and second paper feed paths, or with two tractor sets disposed in the first and second paper feed paths, respectively, both first and second paper feed paths can be deselected and cut-sheet paper may be manually fed along a third path. Thus, the continuous paper form in the one tractor set or both continuous paper forms in the two tractor sets may be parked when the manual paper feed path switch is selected on the control panel. This selection deactivates the clutch assemblies. Cut sheets are then loaded through a guide slot at the top of the printer for manual feed into the nip of the main drive roller and nip rollers. When the load switch is pressed, the sheet will load and printing may commence.

Alternatively, an automatic sheet feeder may be provided. When using an automatic sheet feeder, the tractor set for the second paper path is removed. If a tractor set is located in the bottom or front feed position along the first paper path, the paper in that feed position may be parked. By appropriate selection of controls, the automatic sheet feeder then feeds individual cut sheets into the printer assembly.

Another important feature of the present invention resides in the specific construction of the tractor sets, which are interchangeable for use in each of the first and second paper feed paths. Each tractor set includes a support shaft and a drive shaft disposed between opposite end plates. Conventional tractor drive pin assemblies are carried by the tractor set at locations between the end plates such that the pins may engage the paper feed holes to advance the paper. The end plates carry hooks on one end thereof which engage a tractor support shaft carried by the printer. Adjacent its opposite end, each end plate carries a detent for retaining the tractor set in proper position in the selected paper path. A tractor drive gear is carried by the tractor set at each of its opposite ends and is cooperable with a printer drive gear for advancing paper along the tractor set and, hence, the paper path in part defined by that tractor set. The tractor drive gear is substantially encapsulated or covered by a cap, which forms a part of a tractor set detent. A portion of the tractor drive gear is exposed inwardly of the printer for engagement with the printer drive gear in each of the tractor set feed positions. The detent includes a bulbous end and a recess on that end of the cap. A fixed pin and an axially biased pin are mounted in the printer main frame on respective opposite sides of the paper feed paths in each of the three tractor set feed positions. When the hooks of the tractor set are engaged over the tractor support shaft, the caps are retained by detenting engagement with the pins associated with the selected path. The axially biased pin thus enables the tractor set to pivot into its retained position. The caps also serve as protection for printer operators so that articles of clothing or fingers may not be caught up in the gearing interconnecting the tractor set and printer drive assemblies.

Another feature of the present invention resides in the accurate and stable alignment and adjustment of the printhead. Any instability of the printhead causes the print quality to be inconsistent. A principal source of inconsistent print quality is the radial play in the printhead support shaft and associated bearings in the printer frame. The present invention provides a bearing design which eliminates radial play in the printhead support shaft or other shafts used in the printer without substantial increase in cost. According to this aspect of the present invention, a generally circular bearing is provided with an eccentrically mounted bore, for example, a D-shaped bore. A pair of circumferentially extending springs are located along the outside diameter of the bearing for bearing contact within the housing bore. This eliminates radial play between the bearing and the housing bore. A third cantilevered spring is located within the bearing bore flats. This spring forces the shaft to a contact area within the bearing bore which eliminates radial play between the bearing bore and the shaft. The bearing material preferably is an electrically conductive polycarbonate for static discharge, although any suitable thermoplastic bearing material may be used if static discharge is unimportant.

Another aspect of the present invention resides in a unique roller design for the roller shafts. Previously, solid high-density microcellular urethane rollers have been supplied on a shaft in opposition to low-density microcellular urethane rollers. These individual rollers are conventionally bonded into place and ground to size. In accordance with the present invention, a new roller design eliminates the bonding and grinding operations, uses a single common material, and substantially reduces the costs of the rollers. To accomplish this, the basic roller includes an interior hub defining a bore, an outer rim spaced radially from the hub and a series of generally circumferentially extending cantilevered spokes extending from the hub to the bore in the annular space therebetween. The cantilevered spokes deflect under radial pressure to allow various thicknesses of paper to be driven between mating rollers. The deflection of the spokes causes a spring-back effect, which assists to drive the paper forms. The spokes also allow the rollers to conform to irregular shapes or out of roundness in the mating shaft. Preferably, the bore is smaller in diameter than the shaft and enables an interference fit between the shaft and the roller yet still resists radial slippage during paper drive operations. The material is preferably a thermoplastic rubber (polyolefin) having a coefficient of friction of 1.05 against paper forms.

Another novel and unique aspect of the present invention relates to the zero adjustment striker bar. It will be appreciated by those skilled in this art that accurate positioning of the striker bar in relation to the carriage rails and printhead of a printer is absolutely essential. Previously, positioning has been achieved by secondary operations and various assembly adjustments, all of which can readily come out of adjustment. Printers of this type use a rigid striker bar whose position must be adjusted relative to the carriage rail system for distance and/or perpendicularity. Assembly-line adjustments of this type are both time-consuming and expensive. Existing adjustment systems include adjustable cam surfaces against which the striker bar face is loaded, eccentric cams located in the end of the striker bars which are adjusted after assembly, and snugging-down screws. Often the striker bar is tapped into position with a mallet prior to final securement. Other methods previously employed include using a round striker bar which does not rotate during printer operation but is cammed into position by eccentrics. While a printer frame can be machined to a high degree of accuracy, thus eliminating adjustments, this is a highly expensive operation.

In accordance with the present invention there is provided a one-piece printer mainframe molded of a material and by a process which produces the necessary dimensions to eliminate the striker bar adjustment while maintaining print quality. The mold construction is an important aspect of meeting the necessary dimensional characteristics required to eliminate a striker bar position adjustment. Thus, the present main frame is formed from a mold constructed such that the carriage rail holes and striker bar mounting surface are formed by the same piece of the mold at each end. The left striker bar mounting surface and left carriage rail holes are formed by the left side core of the mold. Similarly, the right striker bar mounting surface and right carriage rail mounting holes are formed by the right side core of the mold. The features that form the left and right striker bar mounting surfaces telescope into and are shut off by the main core of the mold. This minimizes positional and perpendicularity error and variance on each end of the system. Thus, no adjustments of the striker bar and rail or the main drive roller are necessary in accordance with this invention. Additionally, the frame enables the belt tension to be spring adjusted and the cable tension to be self-adjusting.

The material chosen for the mainframe is a fiberglass-reinforced thermoset polyester bulk molding compound which is highly dimensionally stable and considered a "zero shrink" material in relation to mold shrink. Mold shrink is listed in the range of 0 to 0.0005 inch per inch, which is extremely low. Typical ranges for similar percentage reinforcement for amorphous thermoplastics are 0.0010–0.0025 inch per inch. This also helps minimize positional variance. The mold process is injection molding.

In another aspect of the present invention, there is provided a printer ribbon cartridge assembly having various unique features. Not infrequently, it has been found that the conventional mobius loops, for example, as set forth in U.S. Pat. Nos. 4,630,948 and 3,989,132, may sometimes be ineffective to invert the ribbon, resulting in poor quality printing and defects. Part of the problem is caused by insufficient tension on the ribbon between the ribbon storage area and the mobius loop. In accordance with the present invention, there is provided a ribbon tensioner to increase the tension of the ribbon before it enters the mobius loop. This straightens the ribbon and increases the reliability of the ribbon tracking through the mobius loop. The ribbon is tensioned by pulling it about two posts which are disposed perpendicular to the direction of ribbon travel.

Another feature of the ribbon cartridge hereof is the ratchet clutch in the ribbon advance knob. Ribbon failure is not infrequently caused by mishandling of the ribbon cartridge prior to its installation in the printer. For example, an operator may rotate the ribbon advance knob in the wrong direction, hence, fouling the ribbon within the cartridge and causing a ribbon failure. In accordance with the present invention, a clutch mechanism is provided between the advance knob and the pinion drive for the ribbon. Consequently, the ribbon advance knob, when turned in the incorrect direction before installing the cartridge in the printer, does not advance the ribbon. The ribbon can be advanced only when the ribbon advance knob is rotated in the proper direction and the pinion driven through the clutch between the advance knob and the pinion. Another feature of the cartridge of the present invention resides in the fabrication of the upper and lower covers of the cartridge. One of the covers is provided, at spaced longitudinal positions therealong, with a series of elongated recesses and one circular recess. The opposite cover is provided with a series of generally circular pins. The pins are received in the recesses with the one pin in the circular recess to accurately locate the covers relative to one another. As a consequence, the tolerances when joining the covers one to the other are tight in the transverse direction but loose in the longitudinal direction.

Accordingly, it is a primary object of the present invention to provide novel and improved high-speed printer apparatus, including various constructional features, methods of operating the printer, and printer ribbon cartridges for the printer.

In a preferred embodiment according to the present invention, there is provided a printer, comprising a printer frame and a printhead carried by the frame for printing on paper. Means carried by the frame define first and second discrete paper paths for supplying paper to the printhead. Means are provided for continuously feeding paper along each of the respective paper paths to locate the paper fed along one or the other of the paths in position relative to the printhead for printing, including at least one tractor set for engaging and feeding the paper and means for releasably mounting the tractor set in the frame for movement between first and second positions for feeding paper along the first and second paper paths, respectively. Means are also carried by the frame for driving the tractor set when located in position for feeding paper along the first and second paper paths. Also provided are means for selectively actuating the feed means for feeding paper along one of the feed paths including means carried by the frame for driving the tractor set when located in a corresponding position for feeding paper along the one paper path.

In another preferred embodiment according to the present invention, there is provided a printer, comprising a printer frame and a printhead carried by the frame for printing on paper. Means carried by the frame define first, second and third discrete paper paths for supplying paper to the printhead, together with means for continuously feeding paper along the first and second paper paths to locate the paper fed along the first and second paths into position relative to the printhead for printing. The third discrete paper path includes means for feeding cut-sheet paper along the third path into position relative to the printhead for printing. Means are also provided for selectively actuating the feed means for feeding paper along one of the first, second and third feed paths into position relative to the printhead for printing.

In still another preferred embodiment according to the present invention, there is provided a printer, comprising a printer frame and a printhead carried by the frame for printing on paper. Means carried by said frame define first and second discrete paper paths for supplying paper to the printhead, together with means for continuously feeding paper along each of the respective paper paths to locate the paper fed along one or the other of the paths in position relative to the printhead for printing including first and second tractor sets for engaging and feeding the paper along the first and second paths, respectively. Also provided are means carried by said frame for driving the tractor sets and means for selectively actuating the feed means and driving one of the tractor sets for feeding paper along a corresponding one of the feed paths.

In a further preferred embodiment according to the present invention, there is provided a method of operating a printer having a frame, a printhead and a tractor set for advancing paper toward the printhead for printing, comprising the steps of providing first and second discrete paper paths for supplying paper to the printhead, locating the tractor set in a first position along one of the first and second paper paths for advancing the paper along the one path toward the printhead, driving the tractor set when in the first position, to advance the paper along the one path toward the printhead, removing the tractor set from the first position along the one paper path, locating the tractor set in a second position along the other of the first and second paper paths for advancing the paper along the other path toward the printhead, and driving the tractor set when located in the second position to advance the paper along the other path toward the printhead.

In a still further preferred embodiment according to the present invention, there is provided a method of operating a printer having a frame, a printhead and a tractor set for advancing paper toward the printhead comprising the steps of providing first, second and third discrete paper paths for supplying paper to the printhead, providing feed means for feeding continuous paper along the first and second paper paths to locate the paper fed along the first and second paths into position relative to the printhead for printing, providing feed means for feeding cut-sheet paper along the third path into position relative to the printhead for printing, and selectively actuating the feed means for feeding paper along one of the feed paths into position relative to the printhead for printing.

In a still further preferred embodiment according to the present invention, there is provided a method of operating a printer having a frame and a printhead comprising the steps of providing first and second discrete paper paths in the frame for supplying paper to the printhead, providing first and second tractor sets for engaging and feeding the paper along the first and second paths, respectively, providing drive means for each of the tractor sets and selectively actuating the drive means for actuating one of the tractor sets for feeding paper along a corresponding one of the feed paths.

In an even further preferred embodiment according to the present invention, there is provided a tractor set for feeding paper in a printer having a drive gear for driving the tractor set, comprising a pair of mounting members adjacent opposite ends of the tractor set, means for connecting the mounting members one to the other, means carried by the connecting means for advancing paper along the tractor set between the mounting members, including a pair of tractors each including a plurality of drive pins for engaging the paper, and means carried by the mounting members releasably connecting the tractor set to the printer. Means are also provided for driving the paper advancing means, including a gear carried by the tractor set adjacent one end thereof, and an enclosure for the gear carried by the tractor set, the enclosure being configured to extend about substantially a major portion of the exposed portions of the gear teeth of the tractor set drive gear, leaving a portion of the gear teeth exposed for meshing engagement with the printer drive gear whereby users of the tractor set are substantially protected from the meshing engagement of the gears.

In a still further preferred embodiment according to the present invention, there is provided a tractor set for feeding paper in a printer having a drive gear for driving the tractor set, comprising a pair of mounting members adjacent opposite ends of the tractor set, means for connecting the mounting members one to the other, and means carried by the connecting means for advancing paper along the tractor set between said mounting members including a pair of tractors each including a plurality of drive pins for engaging the paper. Means are carried by the mounting members for releasably connecting the tractor set to the printer including means at opposite ends of the tractor set in part defining detents. Also provided are means for driving the paper advancing means, including a gear carried by the tractor set adjacent one end thereof.

In a still further preferred embodiment according to the present invention, there is provided a printer comprising a printer frame and a printhead carried by the frame for printing on paper, and means carried by the housing to define alternate paper paths for feeding paper to a position enabling the printhead to print on the paper, including a tractor set for engaging and advancing paper along the paths toward the print position. Means are provided for mounting the tractor set for movement between positions for feeding paper along the alternate paper paths and for driving the tractor set in each of the tractor set positions.

In a still further preferred embodiment according to the present invention, there is provided a printer comprising a printer frame, a printhead carried by the frame for printing on paper, means carried by the frame for defining first and second paper paths for feeding paper to a position enabling the printhead to print on the paper, including a tractor set for engaging and advancing paper along the paths, means for releasably mounting the tractor set in the frame for movement thereof between positions for feeding paper along the first and second paper paths, respectively, and means for driving the tractor set in each of the positions.

In a still further preferred embodiment according to the present invention, there is provided a paper handling apparatus for a printer comprising a roller formed of an elastic material and having a hub, a rim radially spaced from the hub and a plurality of spokes circumferentially spaced one from the other about the roller and extending between the hub and the rim, each spoke being joined at its ends to the hub and the rim, respectively, at circumferentially different locations about the roller whereby at least one of the spokes exerts a generally radially outwardly directed force against the rim upon inward deflection of a portion of the rim adjacent the one spoke.

In a still further preferred embodiment according to the present invention, there is provided a printer mainframe comprising end plates and a platform spanning between the end plates, the platform and the end plates being integrally molded one with the other, the end plates having printer carriage rail holes and striker bar mounting surfaces dimensioned to eliminate striker bar position adjustments.

In a still further preferred embodiment according to the present invention, there is provided a ribbon cartridge for a printer comprising a housing including an elongated body having ribbon exit and entrance arms adjacent opposite ends and spaced one from the other, with a ribbon disposed in said housing and extending between the entrance and exit arms. Means carried by the housing are provided for pulling the ribbon in one direction from the housing through the exit arm to the entrance arm and into the housing, with manually operable means coupled to the pulling means for rotation in one rotary direction to pull the ribbon in one direction. One-way clutch means interconnect the manually operable means and the pulling means for preventing movement of the ribbon in the opposite direction upon rotation of the manual means in the opposite rotary direction.

In a still further preferred embodiment according to the present invention, there is provided a ribbon cartridge for a printer comprising a housing including an elongated body having ribbon exit and entrance arms adjacent opposite ends of the body and projecting to one side thereof, with a ribbon disposed in the housing and extending between the exit and entrance arms. Drive means are provided in the housing for pulling the ribbon from the housing through the exit arm and into the entrance arm. The housing includes upper and lower covers substantially coextensive with the housing, one of the covers including means defining a plurality of slots spaced one from the other along the edge of one cover, the other of the covers including a plurality of pins extending therefrom for reception in the slots, the slots being elongated in the direction of elongation of the body a distance greater than their width whereby, upon reception of the pins in the slots in an interference fit, the registering slots and pins provide tight tolerances in the transverse direction and loose tolerances in the longitudinal direction. Preferably, one of the covers includes a circular recess for receiving a pin of the other cover whereby the covers are accurately located relative to one another by such single pin engaging in the circular recess.

In a still further preferred embodiment according to the present invention, there is provided a bearing for mounting a shaft, comprising a bearing having an outer cylindrical surface defining a first axis and an internal bore having a generally cylindrical inner surface and defining a second axis radially offset from the first axis. Means are provided carried by the body for mounting a shaft against rotation relative to the body. A pair of cantilevered springs are spaced one from the other about the outer surface, each spring having a proximate end secured to the body, a distal end free of the body and an intermediate portion between the proximate and distal ends substantially conforming to the cylindrical outer surface, the pair of springs being adapted to engage the walls of a bore to force the bearing to a contact area within the bore. An axially extending cantilevered leaf spring extends along the internal surface in an axial direction with proximate and distal ends axially spaced one from the other to eliminate radial play between the bearing bore and the shaft.

These and further objects and advantages of the present invention will become more apparent upon reference to the following specification, appended claims and drawings.

BRIEF DESCRIPTION OF THE DRAWING FIGURES

FIG. 11 is a schematic representation of one end of a tractor set engaging a drive mechanism therefor carried by the housing, the tractor set being illustrated in each of its two pivotal feed positions for feeding paper along alternate paths, i.e., the front or bottom feed paths, of the first paper path;

FIG. 12 is an enlarged cross-sectional view of a retaining element disposed on each of the opposite ends of the tractor assembly and taken about on lines 12—12 in FIG. 15;

FIG. 13 is an enlarged elevational view thereof illustrating the drive gear carried by the tractor assembly within the retaining element;

FIG. 14 is a side elevational view, with parts broken out and in cross-section, of the retaining element;

FIG. 15 is an end elevational view of the retaining element as viewed from its inside;

FIG. 16 is a perspective view of eccentric bearing with anti-radial play features constructed in accordance with the present invention and for use at one end of the shaft;

FIG. 17 is an enlarged end elevational view of the bearing of FIG. 16, with the shaft illustrated within the bearing;

Figure 28:
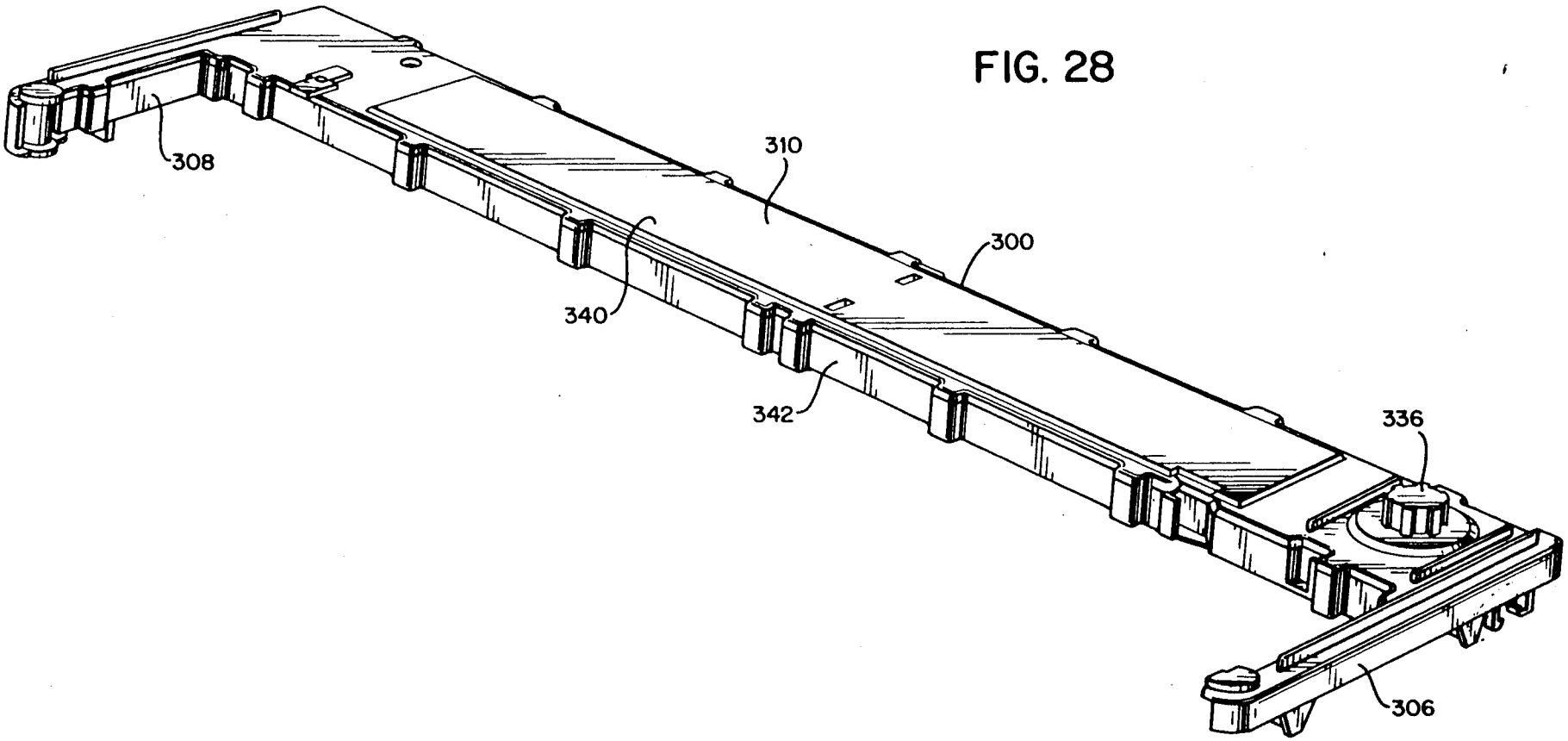
Figures 29, 30, 31, 32:
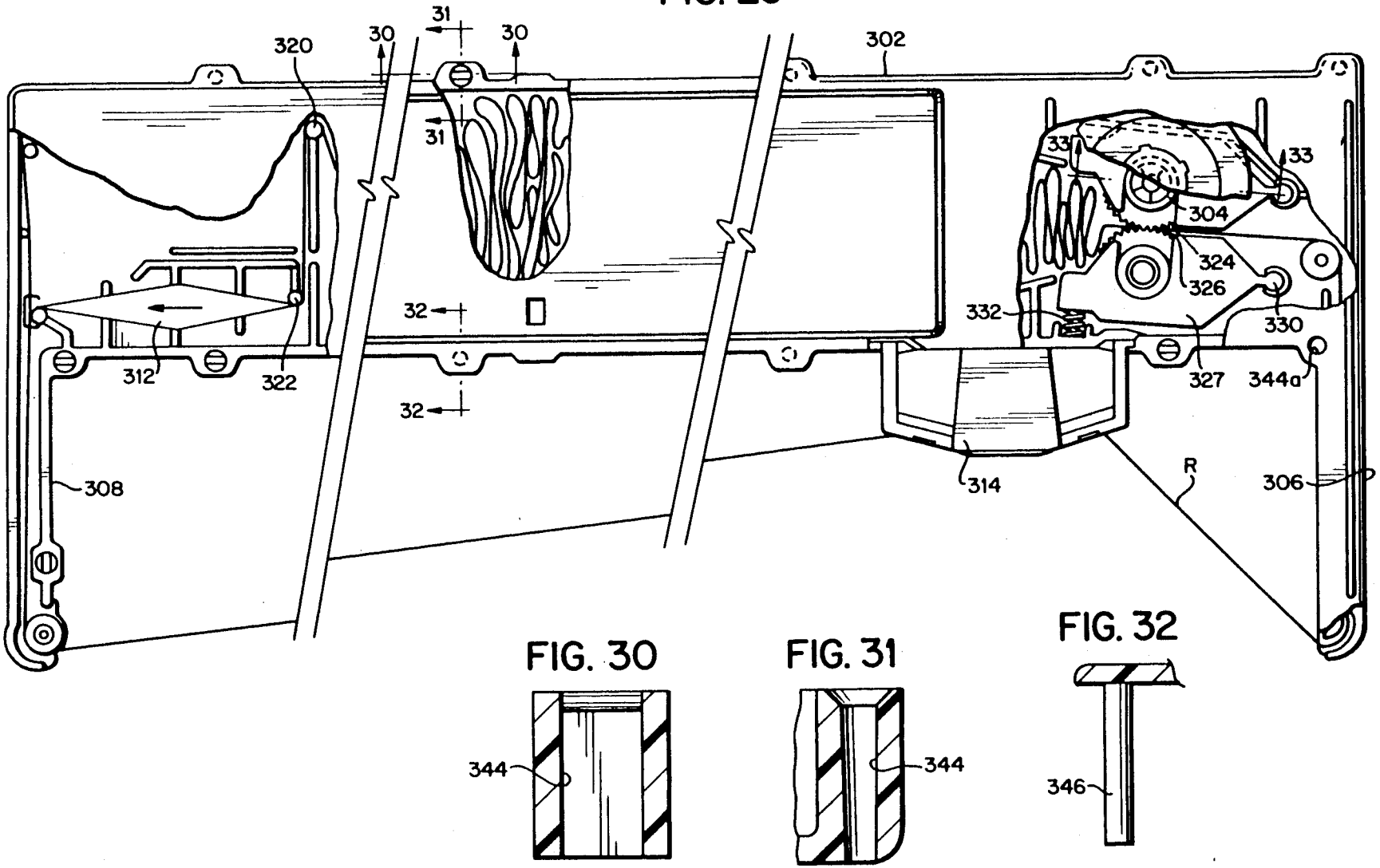

FIGS. 18 and 19 are cross-sectional views thereof taken generally about on lines 18—18 and 19—19, respectively, in FIG. 17;

FIG. 20 is a bottom plan view of the bearing illustrated in FIG. 17;

FIG. 21 is a perspective view of an eccentric bearing with anti-radial play features for use at the opposite end of the shaft;

FIG. 22 is an enlarged elevational view thereof illustrating the shaft;

FIGS. 23 and 24 are enlarged cross-sectional views thereof taken generally about on lines 23—23 and 24—24, respectively, in FIG. 22;

FIG. 25 is a bottom plan view of the bearing illustrated in FIG. 22;

FIG. 26 is an enlarged cross-sectional view of rollers for use in the paper drive system hereof;

FIG. 27 is a side elevational view of a single roller illustrated in FIG. 26;

FIG. 28 is a perspective view of a ribbon cartridge assembly employed in the printer of the present invention;

FIG. 29 is an enlarged top plan view thereof with portions broken out for ease of illustration; and FIGS. 30, 31, 32 and 33 are enlarged cross-sectional views thereof taken generally about on lines 30—30, 31—31, 32—32 and 33—33, respectively. in FIG. 29.

DETAILED DESCRIPTION OF THE DRAWING FIGURES

Reference will now be made in detail to the present preferred embodiment of the invention, an example of which is illustrated in the accompanying drawings.

Figure 1:
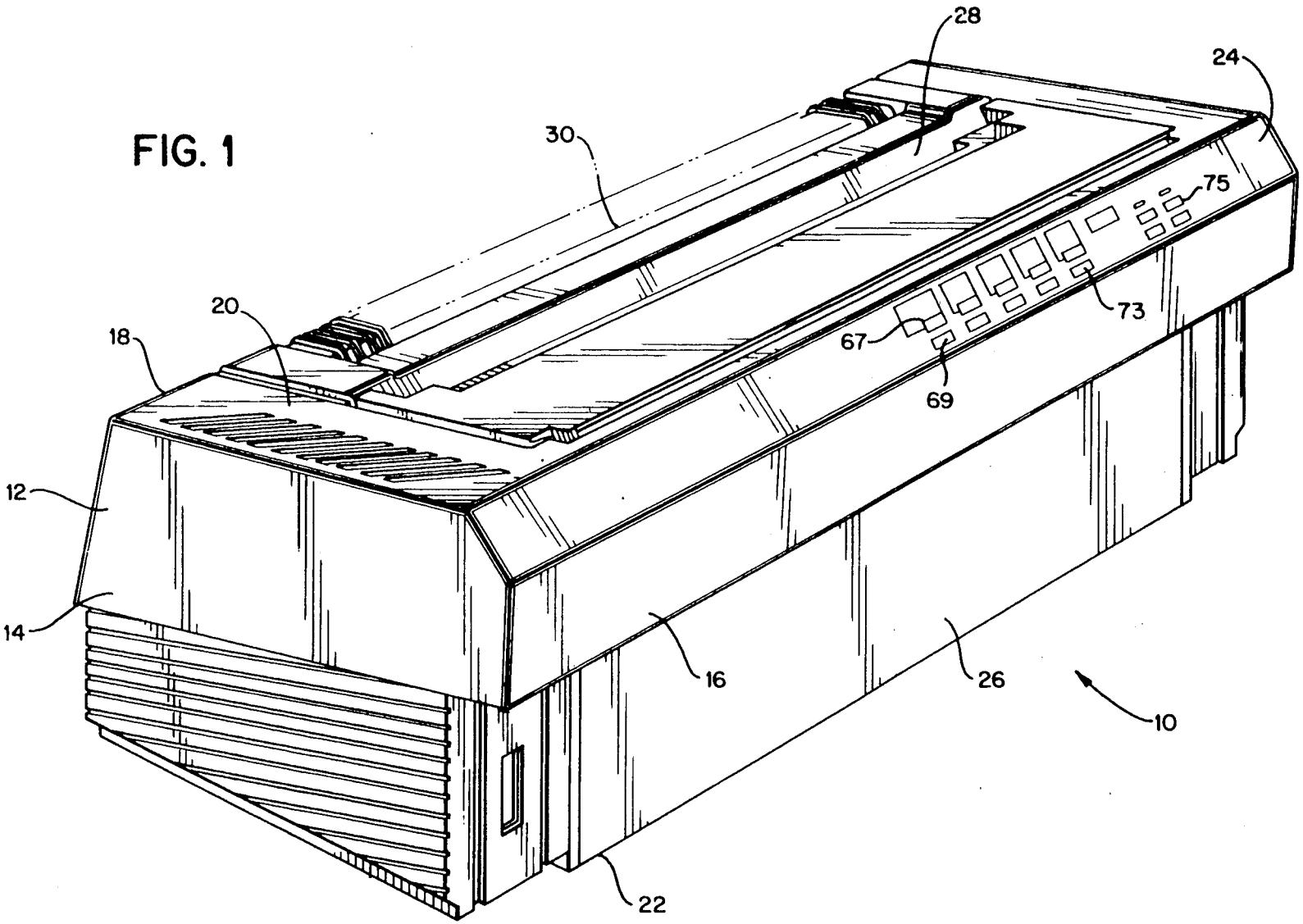
FIG. 1 is a perspective view of a printer constructed in accordance with the present invention looking from the front, top and lefthand end of the printer.
Figure 2:
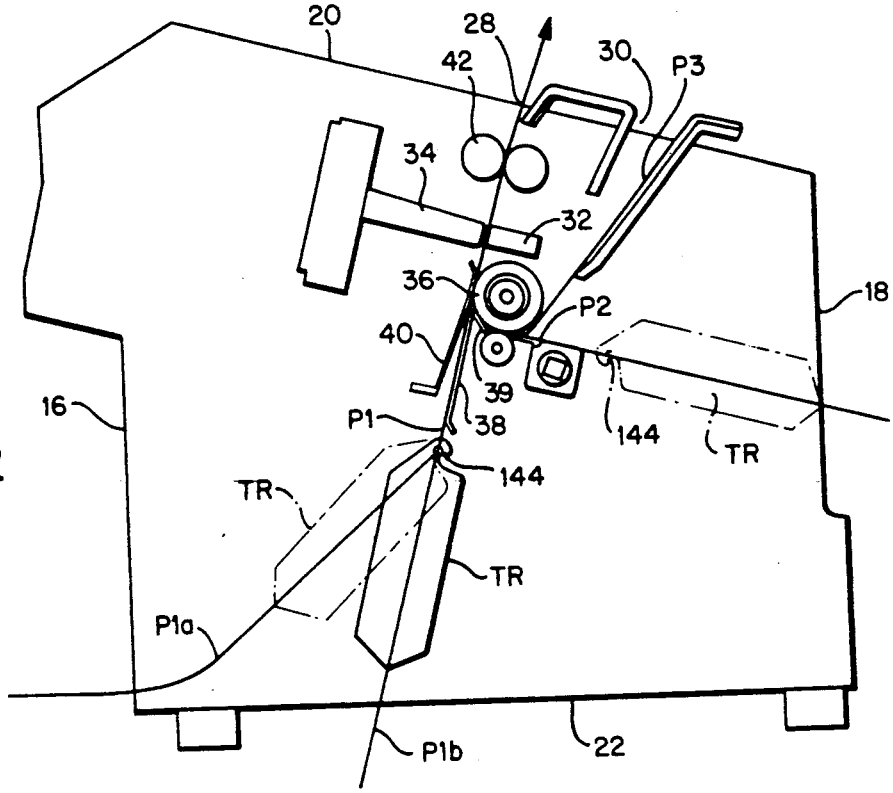
FIG. 2 is a schematic cross-sectional view through the printer between its ends illustrating a single tractor assembly shown in full and dashed lines in bottom or front feed positions, respectively, in a first paper path and in the second dashed-line illustration, in a rear feed position along a second, rear paper path.
Figure 3:
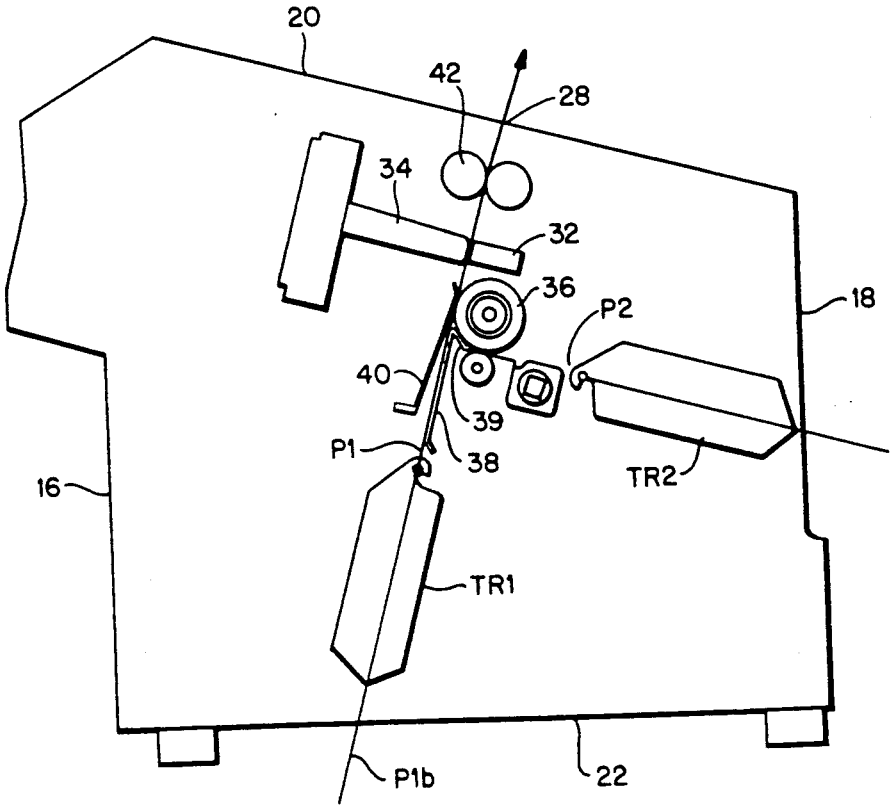
FIG. 3 is a view similar to FIG. 2 illustrating two tractor sets in the first and second paper paths.
Figure 4:
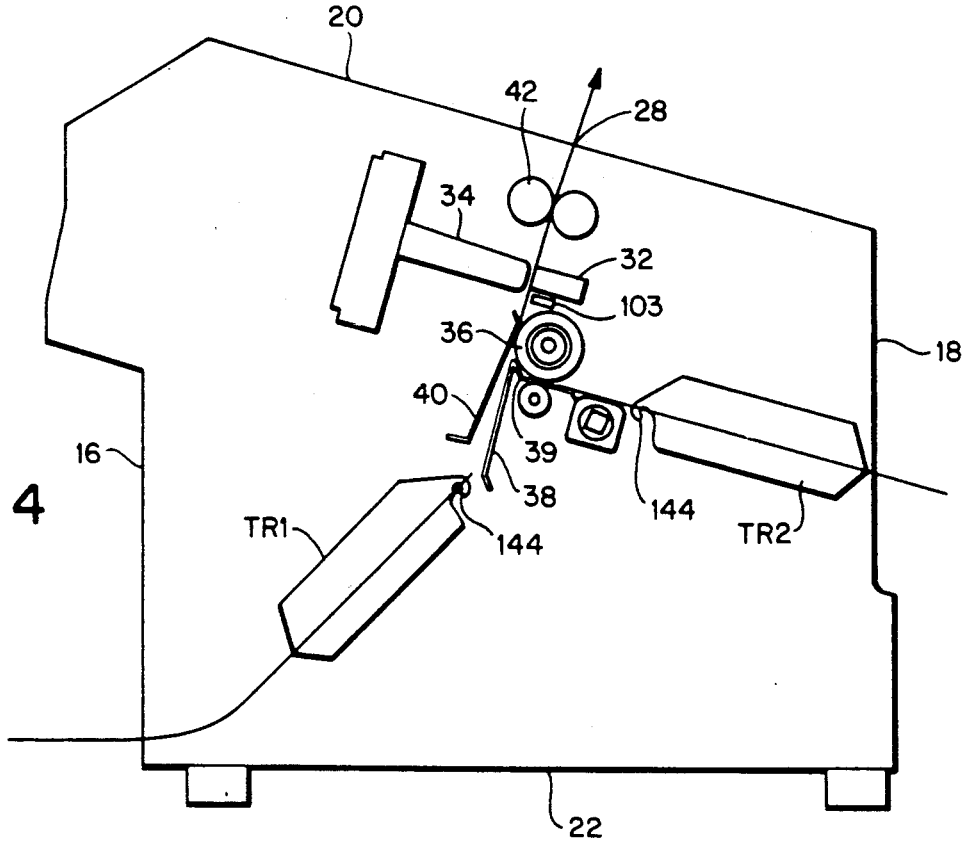
FIG. 4 is a view similar to FIG. 3 illustrating two tractor sets in the first and second paper paths, with the lower tractor set disposed in an alternate front feed position along the first paper path.
Figure 6:
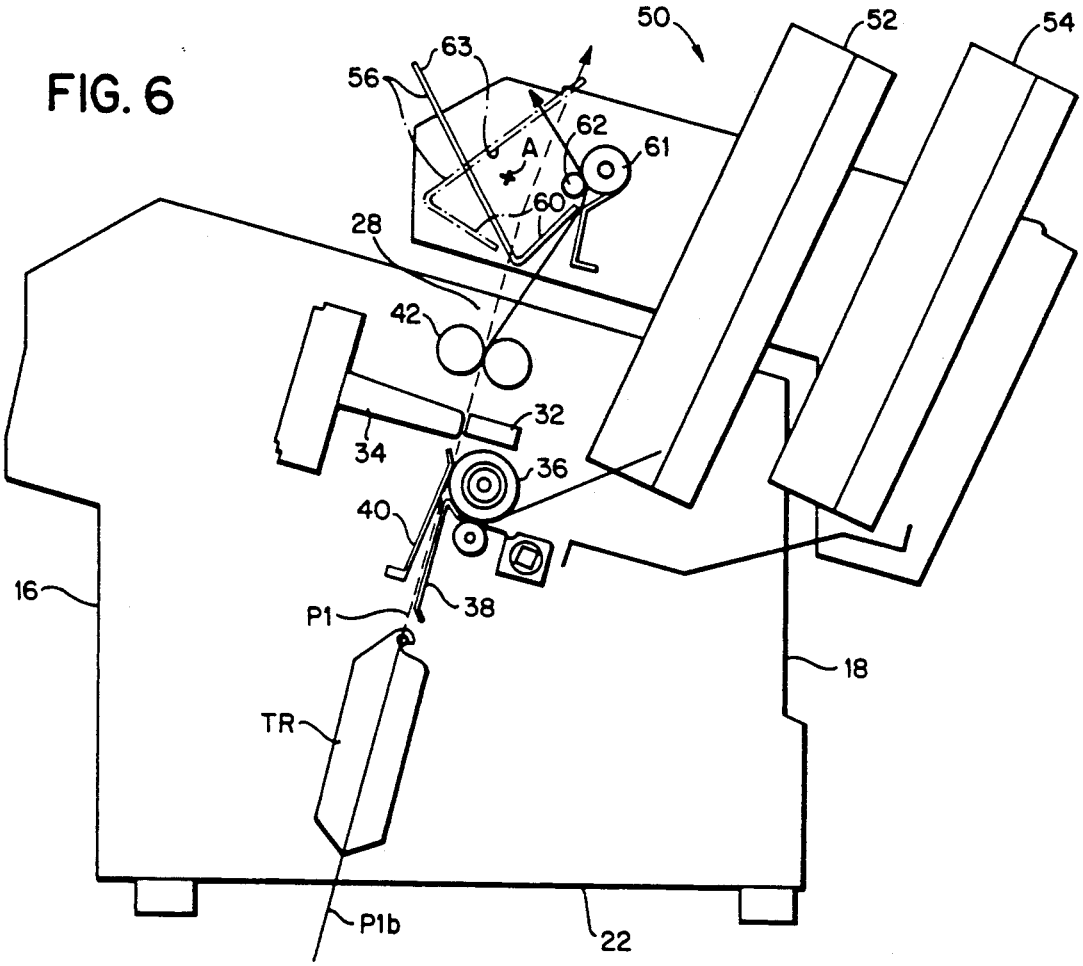
FIG. 6 is a view similar to FIGS. 2-5 illustrating an automatic sheet feeder mechanism for the third paper path and with a tractor located in the first paper path.

Referring now to FIG. 1, there is illustrated a printer, generally designated 10, constructed in accordance with the present invention and comprising a printer housing 12 having discrete faces. For example, printer 10 has opposite end faces 14, a front face 16, a rear face 18, a top face 20 and a bottom face 22. As will be appreciated from a review of FIG. 1, the front face 16 includes an inclined face 24 carrying a control panel having various printer operating controls, more particularly illustrated in FIG. 7. The front face also includes a front panel 26 which can be removed to form part of a paper feed inlet opening for feeding paper from the front of the printer along a first paper path. As schematically illustrated in FIGS. 2, 3 and 6, there is also a paper feed inlet opening in the bottom face 22 of the printer housing for feeding paper along the first path. The rear face 18 also defines, as schematically illustrated in FIGS. 2-4, a paper feed inlet opening for feeding paper along a second paper path. The top face 20 of the housing includes a paper exit slot 28 and a cut paper sheet feeder slot 30.

Turning now to FIGS. 2 through 6, there is schematically illustrated various internal parts of the printer. For example, there is illustrated a striker bar 32, opposite to which there is provided a printhead 34 mounted on a carriage, not shown, for traversing movement along the length of the printer. There is also provided a main paper drive roller 36 which cooperates with a paper pan 38 and an elongated flat paper pinching spring 40 for driving the paper toward the printhead. Paper is supplied along three discrete paper paths. For example, a first paper path P1 is provided for feeding paper continuously through the bottom or front paper inlet feed openings, along the flat side of paper pan 38, and past the main drive roller 36 for printing by printhead 34 and eventual exit from the printer past a set of pinch exit rollers 42. The second paper path P2 is provided for feeding paper continuously through the rear paper feed inlet opening, along a radially contoured side 39 of the paper pan 38 engaging the main drive roller 36 and past the main paper drive roller 36 for printing by printhead 34 and eventual exit past pinch rollers 42. The third paper path P3 is provided for feeding cut paper sheet through the top inlet feed opening 30 onto the contoured side 39 of pan 38, about the main drive roller 36 and past printhead 34 for exit through pinch rollers 42 and exit opening 28.

From a review of FIG. 2, it will also be appreciated that paper path P1 includes, as parts thereof, two alternate paper paths P1a and P1b. Paper path P1a enables paper to be fed continuously through the feed opening in the front face of the printer for disposition along the flat side of paper pan 38 for feed past printhead 34 and exit from the printer through opening 28, as previously described. Alternate paper path P1b enables paper to be fed continuously through the bottom paper feed inlet opening and along the paper pan 38 for feed past printhead 34 and exit from the printer through opening 28.

One or two tractor sets, generally designated TR, may be employed in the present printer, depending upon the needs of the user. For example, with reference to FIG. 2, a single tractor set TR may be variously positioned within the printer housing 12 for feeding paper along each of paper paths P1 and P2. Thus, the tractor set TR illustrated by the full lines in FIG. 2 is in position for feeding paper received through the bottom feed opening along paper path P1. The tractor set TR may be removed from that position and disposed in the dashed-line position illustrated on the right side of FIG. 2 for feeding paper received through the rear feed opening along the paper path P2. Also, the single tractor set, when located in the illustrated full-line position, may be pivoted between the full-line and dashed-line positions illustrated to the left in FIG. 2, so that paper received through the front feed opening may be fed along path P1. Thus, the tractor set TR may be positioned to advance paper received through the bottom feed opening and along path P1b or to advance paper received through the front feed opening and along path P1a for feeding the paper along feed path P1. Stated differently, the single tractor set may be pivoted between alternate positions for either front or bottom loading of paper for continuous feeding thereof along paper path P1 or it may be removed and repositioned for rear loading of paper for continuous feeding thereof along path P2. For purposes of further description herein, paper fed along path P1 may be designated from time to time as paper fed along the bottom or front feed paths and paper fed along path P2 may be designated as paper fed along the rear feed path. It will also be appreciated that when employing a single tractor set, the paper in the tractor set may be parked in any one of the three feed positions of the tractor set illustrated in FIG. 2, while cut sheet paper is fed along paper path P3 for printing.

Figure 5:
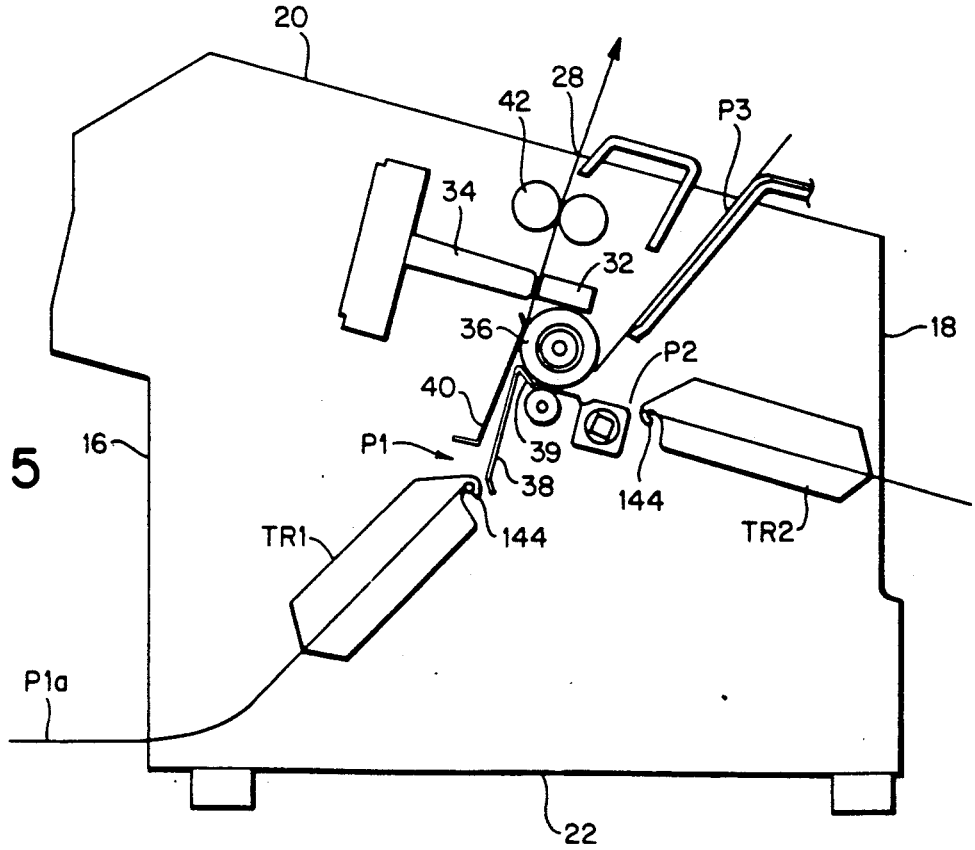
FIG. 5 is a view similar to FIGS. 3 and 4, with the paper parked in each of the two paper paths and illustrating a third paper path for feeding cut-sheet paper from a cut-sheet paper feed assembly at the top of the printer.

In FIGS. 3–5, two tractor sets TR1 and TR2 are employed in a single printer. Thus, paper may be fed alternately along paper paths P1 and P2 depending upon the paper feed inlet opening chosen without repositioning either tractor set. It will be appreciated that the lower tractor set may be pivoted between a bottom paper feed position illustrated in FIG. 3 and a front paper feed position illustrated in FIGS. 4 and 5, both for feeding paper along path P1. For example, in FIG. 3, tractor set TR1 is positioned to feed paper through the bottom paper feed inlet opening along path P1, particularly along path P1b of paper path P1. It will be appreciated that tractor set TR1 may be pivoted into the full-line position illustrated in FIG. 4 so that the paper may be fed through the front paper feed inlet opening along path P1a of paper path P1. Tractor set TR2 may remain in position parking paper along paper path P2 (FIG. 3) as paper is fed along path P1 from either the front or bottom feed positions, i.e., paths P1a and P1b, respectively, of tractor set TR1. Conversely, tractor set TR1 may remain in either of its bottom or front loading positions to park paper along path P1 (FIG. 4) as paper is fed along path P2 from the rear feed opening.

In FIG. 5, cut sheet paper is illustrated being fed along paper path P3. In this illustration, paper may be parked in one or both tractor sets TR1 and TR2 in paper paths P1 and P2, respectively, during the cut paper feed operation. The tractor set TR1 is illustrated in FIG. 5 in the front paper feed position to park paper along path P1a of path P1. It will be appreciated that tractor set TR1 could likewise be positioned in the bottom paper feed inlet position to park paper along path P1b of path P1 during the cut paper feed operation.

In FIG. 6, there is illustrated an automatic sheet feeder, generally designated 50, which constitutes a separate attachment to the printer. The automatic sheet feeder attachment 50 is per se old and conventional except for the pivoted tray which catches the cut-sheet paper fed through the printer along path P3 during automatic sheet feeding and pivots out of way for continuous paper feed operations along path P1. The automatic sheet feeder includes a pair of cut-sheet paper feed bins 52 and 54 for feeding cut sheets along guides to the main drive roller 36. The automatic sheet feeder includes a catch tray 56 pivoted about an axis A between the illustrated full and dashed-line positions. In the illustrated full-line position of tray 56, cut sheet paper exits between pinch rollers 42 and through exit opening 28 between a fixed paper guide 58 and a flange 60 formed on the lower part of tray 56. The paper is directed between a pair of rollers 61 and 62, at least one of which is splined to kick the exiting paper upwardly and away from the nip of the rollers for gravity fall against the inclined back 63 of tray 56 and the inside of flange 60. Consequently, cut sheets are automatically fed from one or the other of bins 52 and 54 along paper path P3 for printing and exit the printer for collection in a stack of printed cut sheets in tray 56.

When a continuous paper feed is desirable with the automatic sheet feeder attached to the printer, the printer hereof has the capability of automatically feeding cut-sheet paper along path P3 or feeding paper continuously through the bottom inlet feed opening or, alternatively, the front inlet feed opening, along path P1. Thus, when it is desired to employ the continuous paper feed from either the bottom or front feed openings, catch tray 56 is emptied of cut sheets and pivoted about axis A such that it assumes a position illustrated by the dashed lines in FIG. 6. By pivoting the tray into that position, exit 28 from the printer is cleared, enabling the paper to feed continuously along path P1 without interference from paper tray 56 or the rollers 61 and 62. Consequently, when the automatic cut sheet feeder is used, the continuous paper may be parked by tractor set TR1 in either of its positions for bottom or front feed. It will be appreciated that when employing the automatic sheet feeder, tractor set TR2 must be removed. Only tractor set TR1 and path P1 may be used for feeding paper continuously as an alternate to the automatic sheet feeder when the latter is disposed on the printer.

Figure 7:
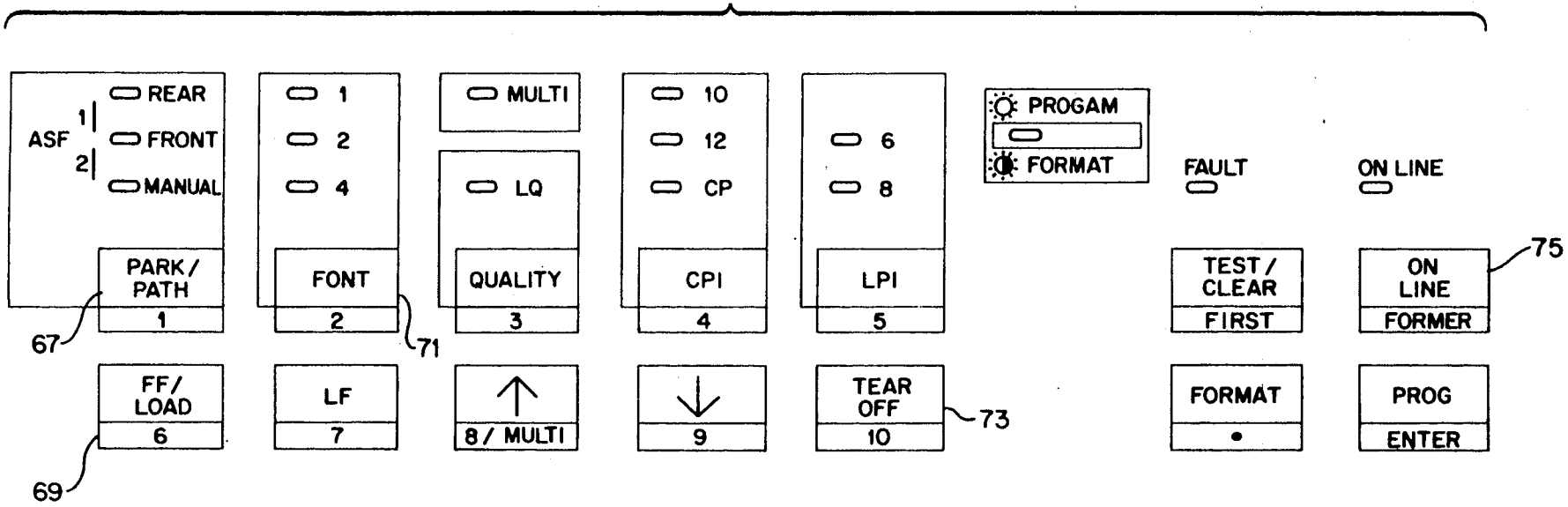
FIG. 7 is an elevational view of the controls located on the front face of the printer.

Referring now to FIG. 7, there is illustrated a control panel from which the various functions of the printer may be controlled. The control panel is, of course, connected to logic circuitry, not shown, by which various commands and printing functions are carried out but which form no part of the present invention. Particularly, there is illustrated a Park/Path control button 67 below three LED lights which identify the paper paths as being the front (bottom), rear or manual paths, i.e, the first, second, and third paths, respectively, described previously. By successively pressing the Park/Path button 67, the switch sequences until the selected path light is lit. Below the Park/Path button 67, there is a FF/Load, i.e., a form feed load, button 69. By pressing this button, the paper is moved to its first line of print from a parked position, or, if paper is detected as already present (not parked), the form is moved to the first line of print of the next page (commonly referred to as a form feed command). A tear-off button 73 is provided which, when actuated, advances the paper until it is aligned at a desired tear-off edge. On-line button 75, upon actuation, starts the normal printing function after the paper paths have been selected and the paper is in proper position for printing. Various other control buttons are provided which are not related to the present invention. For example, there is a font control button 71 for providing printing in various styles.

Figure 8:
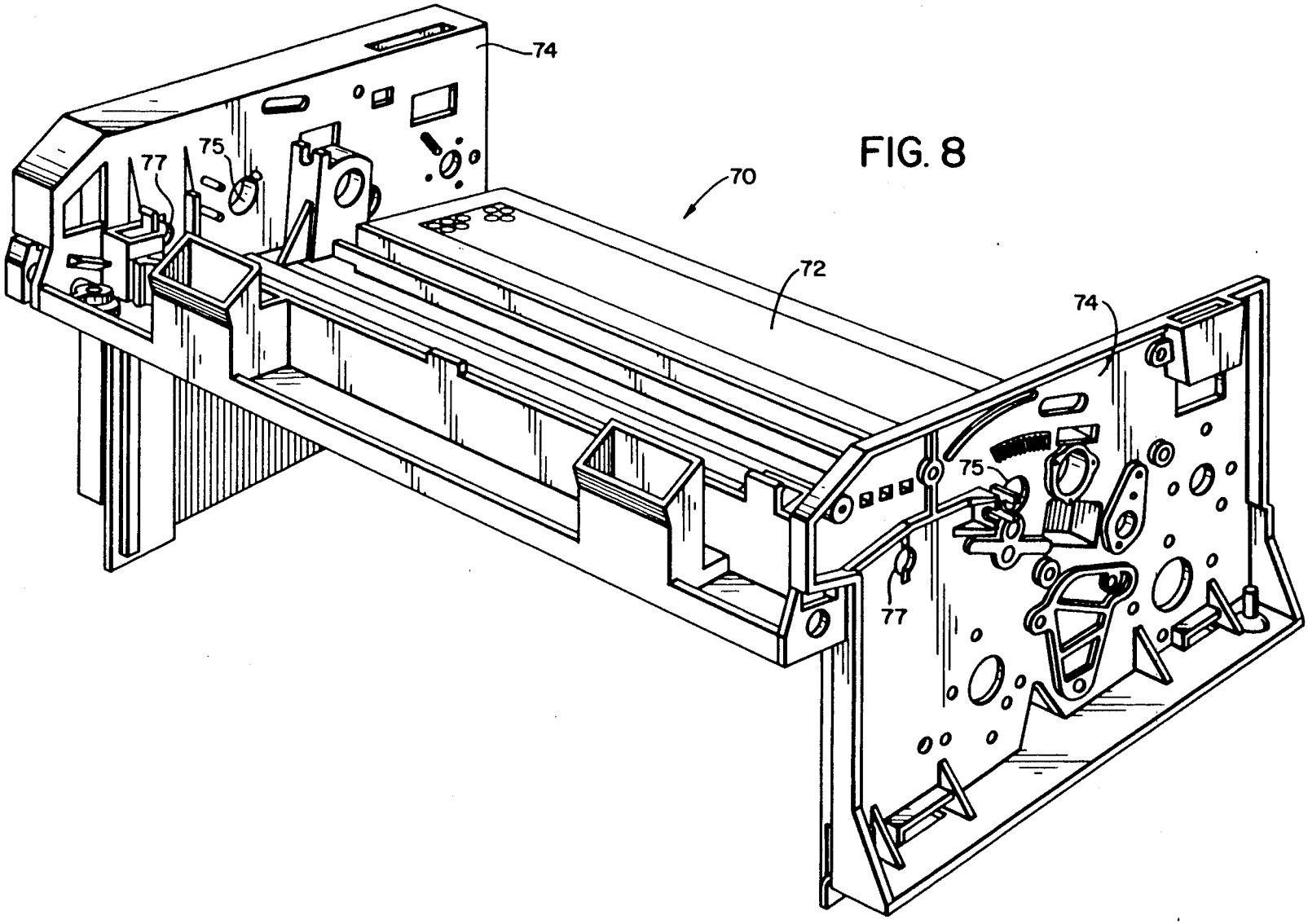
FIG. 8 is a perspective view of a one-piece molded printer main frame.

Referring now to FIG. 8, the main frame of the printer 10 is generally designated 70. The main frame 70 is a one-piece molded construction, preferably a fiberglass-reinforced thermoset polyester bulk molding compound formed by injection-molding techniques. The main frame includes a platform 72 extending between two upstanding end frame plates 74. These end plates 74 are provided with various openings for supporting various component parts, not shown, of the printer assembly and these will be alluded to, as necessary, as the description continues.

Importantly, various components of the end plates 74 are precisely located relative to one another to ensure precision without adjustment. For example, the striker bar 32 is precisely mounted and positioned relative to the print carriage support rails. The striker bar 32 is of rectangular cross-section and has a short side thereof for flush mounting against a precisely located and configured flat surface 73 at each of the opposite ends of the frame. The flat surface 73 is provided with a slot for receiving a screw, not shown, for securing the striker bar 32 in place with no further adjustment. End plates 74 have two carriage rail support openings 75 and 77 which are precisely located relative to one another and flat surface 73. This is provided by side mold parts, not shown, precisely located relative to one another to form those openings. The flat surfaces 73 have zero draft and thus lie exactly parallel one to the other, the openings 77 being tapered outwardly.

Figure 9:
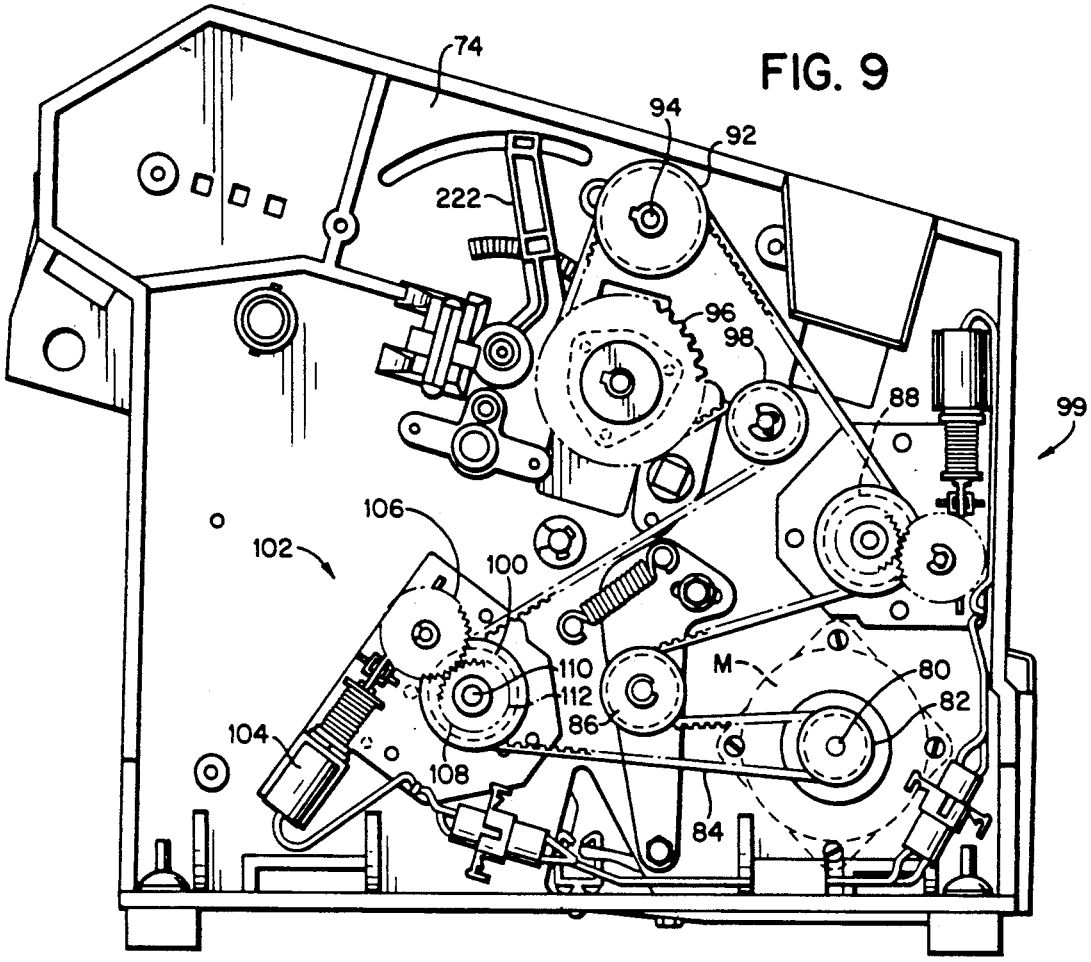
FIG. 9 is an enlarged end elevational view of the righthand end of the printer with its housing removed illustrating the printer drive mechanism.

Referring now to FIG. 9, there is illustrated, in side elevation, the external surface of the side frame plate 74 showing the drive mechanism for the tractor sets and various printer components. As illustrated in FIG. 9, there is provided a main driveshaft 80 connected to an electric motor M. Extending about a pulley 82 on motor driveshaft 80 is an endless cog belt 84. Belt 84 extends about an idler pulley 86 and about a rear tractor set drive pulley 88, which forms part of a rear clutch assembly, generally designated 99, for driving a tractor drive gear 90 (FIG. 10) on the inside of the end frame plate 74, in a manner which will be described hereinafter. Belt 84 extends from the rear tractor drive pulley 88 about a pulley 92 mounted on a shaft 94 for driving exit rollers 42. Belt 84 extends about a main drive roller 96, an idler 98 and about a front or bottom tractor set drive pulley 100 forming part of a front or bottom clutch assembly, generally designated 102. Belt 84 extends from the front or bottom tractor drive pulley 100 back to the main drive pulley 82.

Clutch assemblies 99 and 102 are substantially identical and a description of one will suffice as a description of the other. Each clutch assembly includes a solenoid 104 which, when actuated, axially displaces an idler gear 106 in engagement with a drive gear 108 mounted on a shaft 110 on which the tractor drive gear 90 is mounted. The pulley 100 also carries a gear 112 between it and gear 108. Thus, pulley 100 and gear 112 idle about shaft 110 when the solenoid is in an unactuated position with gear 106 engaging solely drive gear 108. When the solenoid is actuated, gear 106 is displaced axially along gear 108 for joint engagement with gear 108 and gear 112 of the pulley whereby the belt 84 drives the tractor drive gear 90 through gears 112, 108 and shaft 110. Consequently, by activating one or the other of the solenoids of the rear and front or bottom clutch assemblies 99 and 102, respectively, the corresponding tractor drive gears on the interior side of frame plate 74 are rotated, respectively.

Figure 10:
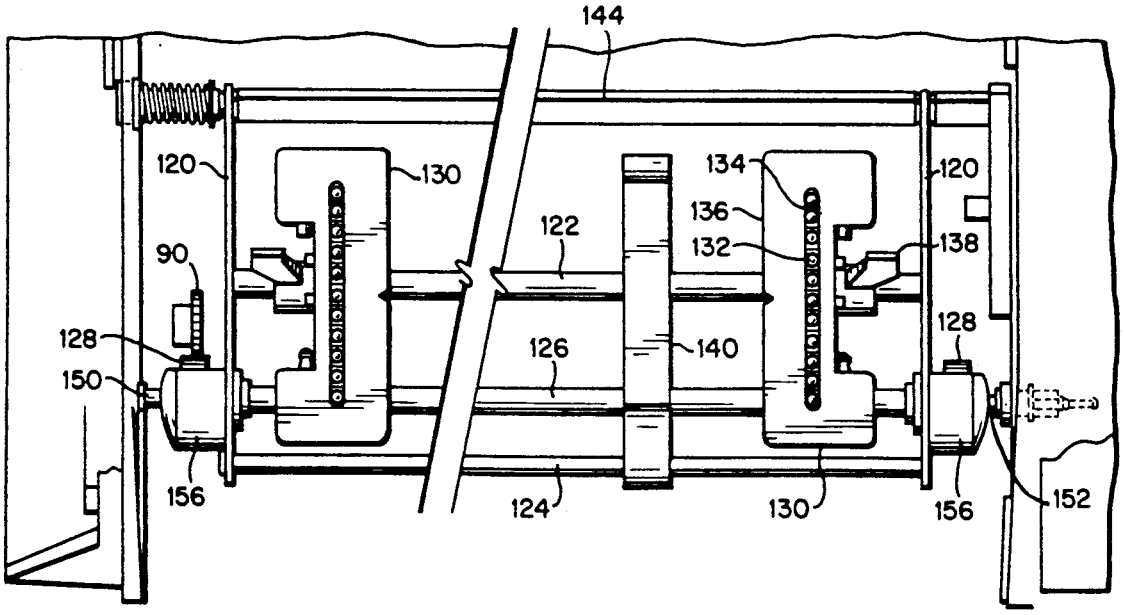
FIG. 10 is an enlarged fragmentary plan view of the printer housing mounting a tractor assembly according to the present invention, with the tractor set located in position for feeding paper along the second paper path.

Turning now to FIGS. 10 and 11, each tractor set includes tractor end plates 120 at respective opposite ends thereof, joined together by a pair of fixed shafts 122 and 124. A tractor set driveshaft 126 also extends between tractor end plates 120 and through the plates 120 to carry a tractor drive gear 128 at each of its opposite ends. Tractors 130 are disposed on the fixed shaft 122 and on the drive shaft 126. The tractors 130 are per se conventional. Suffice to say that each tractor 130 includes an endless belt mounting a plurality of pins 132 which project into slots 134 of a pivoted cover 136. The belt for the pins is driven by shaft 126 and, hence, pins 132 engage in the marginal feed openings of continuously fed paper disposed between the cover 136 and the body of tractor 130. Tractors 130 are displaceable laterally along the tractor set in a conventional manner by movement of levers 138 which form part of a friction clutch assembly. Thus, tractors 130 may be laterally located for registration of tractor pins 132 in the marginal feed openings of paper of different widths. Guides 140 are also mounted on the stationary shafts 122 and 124 and are displaceable laterally therealong depending on the size of the paper being used to assist guiding the paper along the desired feed path.

An important feature of the present invention resides in the configuration of the end plates 120. Referring particularly to FIG. 11, each end plate 120 at the end thereof opposite driveshaft 126 is provided with a hook 142. Each hook 142 engages over a reduced diameter portion of a tractor locating shaft 144 which extends rigidly between the side frame plates 74 of the main frame. Two such locating shafts 144 are provided. One is located such that tractor set TR1 may be pivoted about the locating shaft 144 to feed paper along the alternate front or bottom paper feed paths P1a and P1b, respectively. The other tractor locating shaft 144 extends between side frames 74 and adjacent the main drive roller 36. It forms part of the securement for tractor set TR2 located to supply paper from the rear feed inlet opening along paper path P2.

A detent mechanism is provided at opposite ends of the tractor sets to secure the tractor sets in any one of the three positions thereof, for example, as illustrated in FIG. 2. The detent mechanism includes a pin 150 fixed to one side frame 74 and a spring-biased, axially displaceable, pin 152 fixed to the opposite side frame 74. Thus, each tractor set is held between a tractor locating shaft by hooks 142 on end plates 120 and at its opposite ends by the detent pins 150 and 152. The pins cooperate with a retaining device at each of the opposite ends of the tractor set to secure the tractor sets in their selected positions and to protectively overlie the drive gears.

Referring now particularly to FIGS. 10–15, the retention devices, generally designated 154, each include a cap or cover 156 having a generally cylindrical side wall 158 and a bulbous or convex dome-shaped end 160. Cap 156 has a plurality of legs 162 having catches 164. Legs 162 are received in openings correspondingly located in end plates 120 of the tractor sets whereby the cap is maintained in position on the end of the tractor set substantially overlying and enclosing tractor drive gear 128. As illustrated in FIGS. 11 and 15, cap 156 is cut away along a chordline 166 sufficient that only a portion of gear 128 is exposed outwardly beyond the cylindrical side surfaces 158 of the cap. Cap 156 is positioned such that the opening through the side surfaces 158 formed by the chordline 166 is located inwardly of the paper feed openings which provide access to the tractor assemblies.

In the bulbous ends 160 of each of caps 156, there is provided an opening 168 for receiving pin 150 or 152. To install the tractor set in any one of the three positions previously mentioned, the hooks 142 are disposed about the tractor locator shaft 144. The tractor set is then pivoted to align the openings 168 with the pins 150 and 152. By displacing the pin 152 axially against the bias of the spring, the opposite cap 156 can be located to receive pin 150 in opening 168. By shifting the tractor set slightly in an axial direction toward the fixed pin 150 and permitting the pin 152 to spring bias inwardly to engage in the opening 168, the tractor set is detented in its final position. It will thus be appreciated that the retention member 154 serves not only to detent the tractor set in any one of the three positions noted previously but also serves as a protective cover for the drive gear 128. Because of the placement of the retaining cap 154 between the end plates 120 and the side frames 74, users of the printer cannot obtain access to the gears inwardly of the retention device, which serve to drive the tractor set through the drive gear 128.

Referring back to FIGS. 9 and 10, it will be appreciated that the tractor drive gear 90 carried by the side frame 74 and driven by the belt 84 through clutch assembly 99 lies in meshing engagement with the tractor drive gear 128 when the tractor set is connected to the tractor set locating shaft 144 and detented in position for feeding paper received through the rear paper feed opening for passage along path P2. Note that this drive gear 90 is located on the interior side of the protective retaining cap 154. The tractor drive gear **90*a* associated with the front or bottom clutch assembly 102 is likewise located on the interior face of side frame 74 but lies in engagement with a pair of spaced idler gears 170 and 172 carried by frame 74. Thus, when the tractor set is hooked on locator shaft 144 for feeding paper from the bottom opening along paper path P1 including path P1b, the drive for the tractor set includes gear 90*a*, idler gear 170 and tractor drive gear 128. When the tractor set is pivoted about locator shaft 144 to the position, for example, illustrated by the dashed lines in FIGS. 2 and 11 for feeding paper from the front inlet opening along paper path P1 including path P1a, the drive for the tractor set includes gear 90*a*, idler gear 172 and gear 128. Note in each position, as illustrated in FIG. 11, that retaining cap 154** not only serves to detent the tractor set in the appropriate position but protects the individual moving the tractor sets from the gears during repositioning of the sets.

Referring now to FIGS. 16–25, there are illustrated eccentric bearings with anti-radial play features for use in mounting printer support shafts, for example, the supporting shaft for the printhead. As will be appreciated, precise tolerances are necessary between the supporting shaft, the main printer frame, and the bearings associated therewith, particularly to eliminate radial play. In accordance with the present invention, there is provided an eccentric bearing arrangement for mounting the opposite ends of the printhead support shaft, although it will be appreciated that the eccentric bearings hereof may be used to support other shafts for other purposes and are not limited to mounting a printhead support shaft. Referring now to the embodiment hereof illustrated in FIGS. 16–20, there is illustrated a bearing, generally designated 200, for insertion in a bore, for example, formed in a side frame 74. Bearing 200 has a cylindrical outer surface with an outwardly projecting tab 202 for reception in a corresponding recess adjacent the bore in the side frame plate. The internal bore 204 of the bearing is generally D-shaped, although other shapes may be possible, for receiving a correspondingly D-shaped shaft 206, for example, as illustrated in FIG. 17. It will be appreciated from a review of FIG. 17, that the center of the cylindrical outer surface is designated at 208, while the center of the cylindrical portion of the inner surface 204 of the bore is located at 210. Thus, with the D-shaped configuration of the shaft and bore, rotary motion of the eccentrics at opposite ends of the shaft will displace the shaft and, hence, for example, a printhead carried by the shaft, toward and away from a striker bar.

To eliminate radial play of the shaft, three cantilevered springs are provided on eccentric bearing 200. Two springs 212 form part of the outside diameter of the bearing. More particularly, each cantilevered spring 212 has an outer surface which substantially conforms to the curvature of the outer surface of the bearing and terminates at its distal end in a radially directed bearing surface 214. Cantilevered spring 212 is, of course, spaced from an interior portion 216 of the bearing. The two cantilevered springs 212 extend in opposite circumferential directions. The bearing surfaces 214 thus tend to force the bearing to a contact area within the housing or end plate bore. This eliminates radial play between the outside diameter of the bearing and the end plate bore. The springs 212 are also split axially from the main portion of the bearing. That is, the springs 212 are disposed on one axial side of the bearing and not the other.

The third cantilevered spring 218 is located within the bearing bore flat 219 and extends in an axial direction from one side of the bearing toward the opposite side. This spring forces the shaft 206 to a contact area within the bore of the bearing and eliminates radial play between the bearing bore and the shaft.

Preferably, the bearing material is an electrically conductive polycarbonate useful for static discharge. If static discharge is unimportant, any suitable thermoplastic material may be used. It will be appreciated that the cantilevered springs used for elimination of radial play are suitable for flanged or unflanged bearings and for eccentric or concentric bearings. An example of a flanged bearing is illustrated in FIGS. 21–25, wherein like reference numerals apply to like parts as in the embodiment hereof illustrated in FIGS. 16–20, followed by the suffix "a". In this embodiment, instead of a tab or ear 202, an annular flange 220 is provided about the external circumference of the bearing adjacent one end thereof. Otherwise, the bearing is identical to that described previously.

Referring back to FIG. 9, a lever 222 is disposed alongside frame 74 and is detented into one of a plurality of selected positions. The lever is used for the purpose of rotating the eccentrically mounted shaft, which carries the printhead, to displace the printhead toward and away from the striker bar, depending upon the thickness of the paper employed when printing.

Referring now to FIGS. 26 and 27, there is illustrated a pair of rollers for disposition on shafts on opposite sides of the paper. Solid cellular foam rubber compositions have been used previously for forming rollers of this type and provide an apparent softness, permitting the rollers spaced axially along a pair of parallel shafts to yield sufficiently to prevent divergence of the shafts. However, such materials are expensive. It has been found in accordance with the present invention that the rollers may be specifically designed to provide the same or substantially the same driving force at a greatly reduced cost. Particularly, the rollers of the present invention comprise a hub 240, a bore 242 within the hub, an outer annular rim 244, and a series of cantilevered spokes or connections between the hub 240 and the rim 244. More particularly, the cantilevered springs 246 extend, for example, from the inner hub 240 a short distance radially outwardly and then extend circumferentially a predetermined distance, for example, on the order of 40° to 45°, and then turn radially outwardly for connection with the outer rim 244. All of the cantilevered springs extend from the hub circumferentially in the same direction. In this manner, the springs 246 deflect such that, when a pair of rollers abut one another, different thicknesses of paper may be passed therebetween. The deflection of the springs 246 caused by a flattening of the outer surface imparts a spring-bias to the paper which assists in obtaining the required pressure on the paper to enable the paper to be driven through the printer.

Another advantage of the roller construction described above resides in the capability of the hub to conform to irregular shapes or out-of-round shafts while not affecting the circularity of the annular rim 244. Additionally, the bore 242 is preferably formed slightly smaller than the O.D. of the shaft which mounts the roller. In this manner, an interference fit may be formed between the rollers and shaft, enabling the rollers to be assembled onto the shaft by hand, while at the same time still resist radial slippage during paper driving operations.

Preferably, the rollers are formed of thermoplastic rubber (polyolefin) which has a coefficient of friction of about 1.05 against paper forms. This material is somewhat harder than a cellular foam rubber but the unique configuration gives an apparent softness and ability to yield, while at the same time, providing the required drive force.

Referring now to FIGS. 28–33, there is illustrated a ribbon cartridge for use in the printer of the present invention and generally designated 300. The ribbon cartridge includes a housing 302 for a ribbon drive mechanism 304 for tensioning a printer ribbon R in the span between distal ends of two ribbon entry and exit arms 306 and 308, respectively, between the printhead and the paper on which printing is to be effected. As illustrated in FIG. 29, the ribbon is drawn from left to right from the distal end of exit arm 308 to the distal end of entry arm 306 and from a storage chamber 310. Thus, the tensioning mechanism 304 tensions the ribbon by advancing it into storage area 310 in a series of folds and from which storage area 310 the ribbon is passed through a mobius loop 312, where it is inverted, for exiting the storage chamber via exit arm 308. In the form of ribbon cartridge illustrated in FIG. 29, the cartridge is illustrated in a storage position, with the ribbon threaded through a smudge shield 314 secured along the inside edge of the ribbon cartridge. In using the cartridge, the smudge shield 314 would be removed from the cartridge (and placed on the printhead) and the ribbon R would span between the distal ends of the arms 306 and 308.

In accordance with the present invention, there is provided a ribbon tensioner between the storage area 310, particularly the double dams in that area (see U.S. Pat. No. 3,989,132), and the mobius loop 312 for purposes of increasing the tension on the ribbon before it enters the mobius loop. This increase in tension tends to straighten the ribbon and, hence, provide increased reliability of the ribbon tracking through the mobius twist. To increase the tension, a pair of posts 320 and 322 are disposed adjacent opposite sides of the cartridge housing. The posts extend perpendicular to the direction of ribbon travel. Thus, the frictional engagement of the ribbon under tension about the two posts 320 and 322 tends to increase the tension on the ribbon before entering mobius 312, enabling the ribbon to track more reliably through the mobius. Absent the ribbon tensioning posts, the ribbon might not invert in the mobius and could exit the mobius, only to invert after it leaves exit arm 308 in the print area which, of course, would lead to defective printing.

Figure 33:
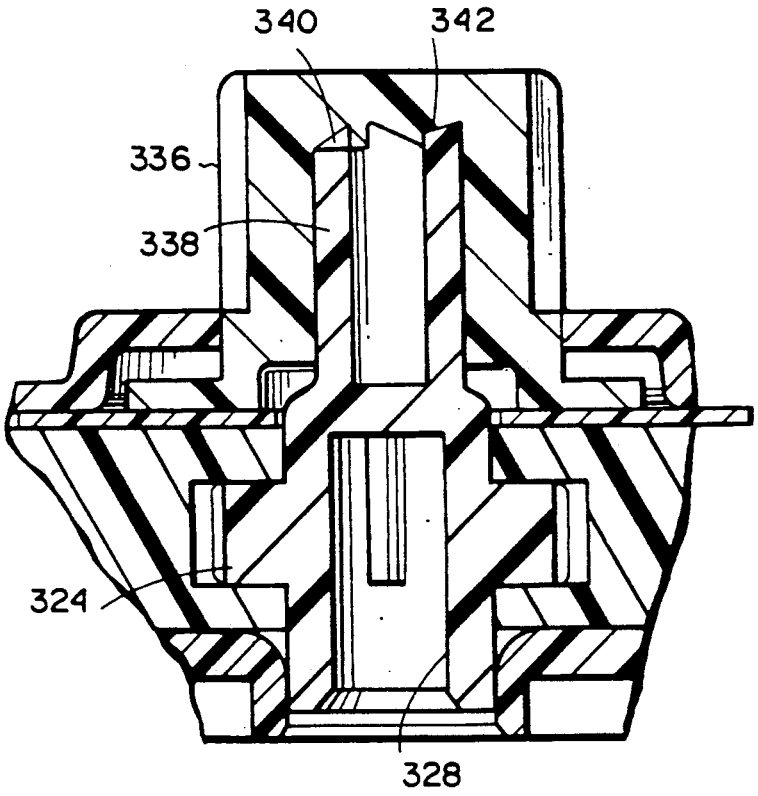

Also in accordance with the present invention, there is provided a one-way ratchet clutch for advancing the ribbon manually. It is important to prevent the inadvertent reverse drive of a ribbon by an operator turning the advance knob on the cartridge in the wrong direction. This could result in a ribbon failure. Previously, one-way clutches have been used in the ribbon drive motor of the printer but these have required frequent service and were unreliable. Thus, in accordance with the present invention, the one-way clutch is provided on the cartridge itself for purposes of preventing advancement of the ribbon in the wrong direction, even when the cartridge is not installed on the printer. Absent a one-way clutch on the cartridge, the cartridge could fail prior to installation on the printer because of mishandling. More particularly, a pair of gears 324 and 326 are provided in the drive mechanism for advancing the ribbon therebetween. The drive gear 324 is driven by a pinion, not shown, on the printer and which pinion is received in the cylindrical splined recess 328 on the underside of the cartridge, as illustrated in FIG. 33. The other gear 326 is carried by a member 327 which is pivoted about a pivot 330 and biased by spring 332 into engagement with the gear 324. Consequently, by engaging the pinion in gear 324, the ribbon may be advanced, for example, by rotating gear 324 in a clockwise direction, as illustrated in FIG. 29.

When the cartridge is first supplied to a user, it is necessary to remove the slack in the ribbon between the entry and exit arms 306 and 308, respectively. To accomplish this, there is provided an advancing knob on the opposite side of the cartridge from its engagement with the cartridge drive pinion on the printer and which receives a projecting pin 338 from gear 324. The projecting pin 338 has gear teeth 340 on its upper annular end face. The inner end face of the bore of knob 336 is provided with matching ratchet teeth 342. Thus, rotation of the knob in one direction, for example, in the counterclockwise direction illustrated in FIG. 29, permits the ratchet teeth to slide over the ratchet teeth on the end of the shaft 338 without rotating the gear 324. However, rotation of the advancing knob 336 in the opposite direction permits the ratchet teeth of the knob to engage the ratchet teeth on the shaft 338, whereby the gear 324 may be rotated in a clockwise direction, as illustrated in FIG. 29. In this manner, the ribbon may be advanced only in the proper direction.

Another feature of the present invention resides in the connection between the upper and lower covers of the cartridge. It will be appreciated from a review of FIG. 28, that the cartridge is formed of an upper cover 340 and a lower cover 342. Spaced longitudinally along the inside and outside edges of the lower cover 342 and also along the arms 306 and 308 are a plurality of recesses 344 elongated in the long direction of the cartridge. At corresponding longitudinal and transverse positions along the cartridge, there is provided a plurality of projecting pins on the upper cover 340 for engaging in recesses 344. The pins are generally cylindrical. Consequently, it will be appreciated that, when the cartridge is assembled, pins 346 are inserted into the generally rectangular openings 344. Additionally, it will be appreciated from a review of FIG. 31 that the long walls of recesses 344 are tapered inwardly toward one another. Consequently, when the cartridge covers are assembled and pins 346 received in the recesses 344, there is provided an interference fit in a lateral direction but a rather large tolerance for the fit in the longitudinal direction. To accurately locate the covers relative to one another, one recess 344*a* is cylindrical and receives a cylindrical pin thereby providing both longitudinal and transverse relative positioning of the covers.

In use, the ribbon cartridge is disposed in the printer 10 in the usual fashion and connected with a drive pinion, not shown, so that the printer ribbon may be advanced during printing. Where one tractor set is used, it is disposed on one or the other of the tractor support shafts, depending upon which paper path is desired. For example, if a bottom feed is desired, the tractor set TR is disposed on the lower tractor support shaft 144 and detented into the lowermost position between the fixed and axial biased pins 150 and 152, respectively. Paper is disposed in the tractors 130 of the tractor set TR in a conventional manner. The Park/Path button 67 is pressed until Front is indicated (FIG. 7) which readies the solenoid 104 of the clutch assembly 102. The FF/Load button is then pushed to energize solenoid 104 to engage clutch assembly 102. The paper is then fed by the tractor set TR past the paper pan 38 for engagement by the drive roller 36 until the paper is sensed by an optical sensor located below the striker bar 32 (see FIG. 4 at 103 for the optical sensor). When the forward edge of the paper is sensed by sensor 103, the paper is then stepped under a logic control, not shown, to line up for a first line of print in line with the printhead, at which time the motor stops. The printer is now ready for printing paper fed along paper path P1, including alternate path P1b. The On-Line button 75 is then pressed and normal print commands, as will be recognized by those skilled in the art, are actuated, whereby printing commences.

It will be appreciated that when the tractor set TR is located in the bottom position, paper feed can be changed from the bottom opening to the front opening by pivoting the tractor set TR. For example, the paper from the bottom feed opening is disconnected and removed and the tractor set TR is snapped from its detented position, pivoted about the lower tractor locator shaft 144 and detented into the feed position for feeding paper along path P1, including path P1a, via the alternate front feed path. Front remains indicated adjacent the Park/Path button, solenoid 104 of clutch assembly 102 remains ready for actuation and paper feed may be continued along path P1 but including path P1a. Thus, the clutch assembly 102 and corresponding solenoid 104 are used for both the front or bottom feed locations of tractor set TR.

A similar operation can be performed by the single tractor set TR for feeding paper from the rear opening along paper path P2. Thus, the tractor set TR may be removed from the lower tractor support shaft 144, endwise reversed and located such that the hooks connect with the upper tractor locator shaft 144. It will be appreciated that tractor set TR is detented into this position between the associated fixed and axially biased pins 150 and 152 located adjacent the rear feed opening. To print with the paper located in the tractor set along path P2, the same operational sequence is performed, except that the Park/Path button 67 is pressed until Rear is indicated which readies the rear solenoid 104 of clutch assembly 99. The Form Feed/load button 69 is then pressed to energize the solenoid 104 associated with clutch assembly 99. This drives the tractor set TR to advance the leading edge of the paper along path P2 until detection by the optical sensor, at which time, the paper is stepped to align it properly for the first line of print. The printer is now ready to print paper fed along path P2. On-Line button 75 is then pressed and normal printing operations are commenced.

Where two tractor sets TR1 and TR2 are employed, as illustrated in FIG. 3, the same or different types of paper may be fed into the tractor sets TR1 and TR2. The Park/Path control button 67 is then pressed to provide for either Rear or Front feed. If Front feed is selected, the solenoid 104 for the front clutch assembly 102 is readied for energization. The FF/Load button 69 is thereafter pressed to energize solenoid 104 and actuate clutch assembly 102. The paper in tractor set TR1 will then advance into the print position along path P1 as previously described. Because the clutch assembly 99 for the rear tractor TR2 remains in an unactuated state, the paper in the tractor set TR2 remains parked. It will also be appreciated that the paper will feed from either the bottom or front feed positions depending upon which of the two positions is desired by location of the paper and the tractor set TR1.

If it is desired to feed paper for printing along path P2 and deactuate the paper feed along path P1, and assuming the printing along paper path P1 has stopped, the FF/Load button is pressed to locate the paper in position to receive a first line of print of next page. The Tear-Off button 73 is pushed to advance the paper in tractor set TR1 to an appropriate tear-off position. After a predetermined time period and after the excess paper is removed, the paper drive is reversed to obtain its first line of print position. The Park/Path button 67 is then pressed, identifying the paper in the front paper path P1 as the path to be parked. The motor then withdraws the paper until the optical sensor senses the top leading edge of the paper, at which time the logic counts a predetermined number of steps until the top edge is within the lower tractor set TR1. The paper along path P1 is now parked in lower tractor set TR1. The Park/Path button 67 is then pressed again until the rear paper path, i.e., Rear, is indicated. The FF/Load button 69 is then pressed to actuate the solenoid, whereby the tractor set TR2 advances the paper along path P2 to a first line of print position. The On-Line button 75 may then be pressed to commence normal printing operation.

To employ the manual feed for cut-sheet paper, as illustrated in FIG. 2, the paper along the rear paper path must first be parked if that was the paper used during the last print operation. The FF/Load button is pressed, followed by the Tear/Off button 73. The Park/Path button 67 is pressed to identify the paper in the rear paper path P2 as the paper to be parked. The motor then withdraws the paper until the top edge is within the rear tractor set TR2 to park the paper. The Park/Path button is then pressed until Manual is indicated. The FF/Load button 69 is then pressed and the motor advances the paper manually fed into the nip of the drive roller and pan portion 39 through the drive rollers 36 such that its leading edge cuts the optical sensor. The paper thereafter automatically indexes to a first line of print position. The paper is now ready to be printed and whatever print command is desirable may be actuated. To eject the single cut-sheet paper, the form feed button may be used or the logic circuit will eject the paper automatically.

To use the automatic form feeder, the tractor set TR2 must be removed from the position illustrated in FIG. 3 in order to provide sufficient space for the automatic sheet feeder. The automatic feeder is per se conventional (except as previously noted).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ribbon cartridge for a printer comprising:

a housing including an elongated body having ribbon exit and entrance arms adjacent opposite ends and spaced one from the other;

a ribbon disposed in said housing and extending between said entrance and exit arms;

means carried by said housing for pulling said ribbon in one direction from said housing through said exit arm to said entrance arm and into said housing;

manually operable means coupled to said pulling means for rotation in one rotary direction to pull said ribbon in said one direction;

one-way clutch means interconnecting said manually operable means and said pulling means for preventing movement of said ribbon in said opposite direction upon rotation of said manual means in the opposite rotary direction; and said housing including upper and lower covers substantially coextensive with said housing, one of said covers including means defining a plurality of slots spaced one from the other along the edge of said one cover, the other of said covers including a plurality of pins extending therefrom for reception in the slots, said slots being elongated in the direction of elongation of said body a distance greater than their width whereby, upon reception of said pins in said slots in an interference fit, the registering slots and pins provide tight tolerances in the transverse direction and loose tolerances in the longitudinal direction.

2. A ribbon cartridge according to claim 1 including means defining a storage area within said housing for the ribbon, a mobius loop in said housing for inverting ribbon exiting said storage area and means for increasing the tension on the ribbon after it leaves the storage area and before it enters said mobius loop including a pair of posts about which the ribbon is received thereby increasing frictional contact with the ribbon, and hence ribbon tension, enabling the ribbon to track effectively through the mobius loop.

3. A ribbon cartridge for a printer, comprising:

a housing including an elongated body having ribbon exit and entrance arms adjacent opposite ends of said body and projecting to one side thereof;

a ribbon disposed in said housing and extending between said exit and entrance arms;

drive means in said housing for pulling said ribbon from said housing through said exit arm and into said entrance arm;

said housing including upper and lower covers substantially coextensive with said housing and on opposite sides of said ribbon in said housing, one of said covers including means including means defining a plurality of slots spaced one from the other along an edge of said one cover, the other of said covers including a plurality of pins extending therefrom for reception in the slots, said slots being elongated in the direction of elongation of said body a distance greater than their width whereby, upon reception of said pins in said slots in an interference fit, the registering slots and pins provide tight tolerances in the transverse direction and loose tolerances in the longitudinal direction.

4. A ribbon cartridge according to claim 3 wherein one of said covers includes a circular recess and the other of said covers includes a cylindrical pin whereby the covers are accurately located relative to one another by said cylindrical pin engaging in said circular recess.

5. A ribbon cartridge according to claim 4 wherein said elongated slots have opposite walls tapering toward one another in a direction away from the opening of the slot for receiving cylindrical pins in interference fits.

6. A ribbon cartridge for a printer comprising:

a housing including an elongated body having ribbon exit and entrance arms adjacent opposite ends and spaced one from the other;

a ribbon disposed in said housing and extending between said entrance and exit arms;

means carried by said housing for pulling said ribbon in one direction from said housing through said exit arm to said entrance arm and into said housing;

manually operable means coupled to said pulling means for rotation in one rotary direction to pull said ribbon in said one direction;

one-way clutch means interconnecting said manually operable means and said pulling means for preventing movement of said ribbon in said opposite direction upon rotation of said manual means in the opposite rotary direction; and said pulling means comprising a gear and a mating connecting structure on one side of said gear for connection to a drive structure carried by the printer, said manually operable means being carried by said gear on the opposite side thereof, said gear having a pin projecting from said opposite side thereof, said manually operable means including a knob overlying said pin with said one-way clutch means cooperable between said pin and said knob.

7. A ribbon cartridge according to claim 1 wherein said pulling means comprises a gear and a mating connecting structure on one side of said gear for connection to a drive structure carried by the printer, said manually operable means being carried by said gear on the opposite side thereof.

8. A ribbon cartridge according to claim 6 wherein said one-way clutch includes cooperable ratchet teeth carried by said knob and said pin.

9. A ribbon cartridge according to claim 8 wherein said knob has a recess for receiving said pin and an end face in opposition to the end face of said pin, said ratchet teeth lying on said end faces.

10. A ribbon cartridge according to claim 6 including means defining a storage area within said housing for the ribbon, a mobius loop in said housing for inverting ribbon exiting said storage area and means for increasing the tension on the ribbon after it leaves the storage are and before it enters said mobius loop including a pair of posts about which the ribbon is received thereby increasing frictional contact with the ribbon, and hence ribbon tension, enabling the ribbon to track effectively through the mobius loop.

11. A ribbon cartridge according to claim 6 wherein said housing includes upper and lower covers substantially coextensive with said housing, one of said covers including means defining a plurality of slots spaced one from the other along the edge of said one cover, the other of said covers including a plurality of pins extending therefrom for reception in the slots, said slots being elongated in the direction of elongation of said body a distance greater than their width whereby, upon reception of said pins in said slots in an interference fit, the registering slots and pins provide tight tolerances in the transverse direction and loose tolerances in the longitudinal direction.

* * * * *